US005908536A

United States Patent [19]

Kaasalainen et al.

[11] Patent Number: 5,908,536

[45] **Date of Patent: *Jun. 1, 1999**

[54] METHOD AND MACHINE FOR REMOVING WATER FROM A PAPER OR BOARD WEB BY PRESSING

[75] Inventors: Heikki Kaasalainen, Jyväskylä ; Jukka Kinnunen, Nokia; Jorma Laapotti, Palokka; Nils Söderholm, Anjalankoski, all of Finland

[73] Assignee: Valmet Corporation, Helsinki, Finland

[ * ] Notice: This patent is subject to a terminal disclaimer.

[21] Appl. No.: 08/980,993

[22] Filed: Dec. 1, 1997

Related U.S. Application Data

[63] Continuation-in-part of application No. 08/725,413, Oct. 3, 1996, Pat. No. 5,792,320.

[30] Foreign Application Priority Data

Oct. 3, 1995 [FI] Finland ..... 954698

[51] Int. Cl.[6] ..... D21F 2/00; D21F 3/02

[52] U.S. Cl. ..... 162/205; 162/210; 162/358.3; 162/360.2; 162/305; 162/306

[58] Field of Search ..... 162/205, 210, 162/358.3, 360.2, 305, 306

[56] References Cited

U.S. PATENT DOCUMENTS

| | | | |
|---|---|---|---|
| 3,595,745 | 7/1971 | Cronin | 162/306 |
| 3,671,389 | 6/1972 | Wahlstrom et al. | 162/306 |
| 4,468,287 | 8/1984 | Dahl | 162/358.3 |
| 4,483,745 | 11/1984 | Wicks et al. | 162/360.2 |
| 4,568,423 | 2/1986 | Laapotti | 162/358.3 |
| 4,909,903 | 3/1990 | Mullner | 162/358.3 |
| 4,931,142 | 6/1990 | Steiner et al. | 162/358.3 |
| 4,976,821 | 12/1990 | Laapotti | 162/360.2 |
| 5,368,697 | 11/1994 | Steiner et al. | 162/360.2 |
| 5,389,205 | 2/1995 | Pajula et al. | 162/205 |
| 5,468,349 | 11/1995 | Schiel | 162/360.2 |

FOREIGN PATENT DOCUMENTS

| | | |
|---|---|---|
| 565514 | 11/1958 | Canada . |
| 0359696 | 3/1990 | European Pat. Off. . |
| 860746 | 12/1952 | Germany . |
| 9429519 | 12/1994 | WIPO . |

*Primary Examiner*—Karen M. Hastings
*Attorney, Agent, or Firm*—Steinberg & Raskin, P.C.

[57] ABSTRACT

A paper or board machine and a method for passing a paper or board web from a forming section to a press section in a paper or board machine wherein the web is carried on a first wire in the forming section or transferred to a first wire from a forming wire of the forming section. The web that runs on the first wire is made to adhere in a transfer and pre-press zone to an outside face of a transfer belt which is substantially non-water-receiving. The pre-press zone includes an extended nip defined by an extended-nip roll and a smooth-faced press roll, the extended-nip roll having a hose mantle and a press shoe arranged in a loop of the hose mantle. After this pre-press zone, the web is separated substantially immediately from the wire and passed on support of the transfer belt onto the next press fabric in the press section and/or into the next press nip. In the pre-press zone or zones, a substantial amount of water is removed out of the web substantially in one direction only, and, at the same time, the web is made to adhere reliably to the outside face of the transfer belt.

23 Claims, 12 Drawing Sheets

METHOD AND MACHINE FOR REMOVING WATER FROM A PAPER OR BOARD WEB BY PRESSING

This application is a continuation-in-part of U.S. patent application Ser. No. 08/725,413 filed Oct. 3, 1996 now U.S. Pat. No. 5,792,320.

FIELD OF THE INVENTION

The present invention relates to a method for removing water from a paper or board web and for passing the web as a closed draw from a forming wire or transfer wire of the web former to a press section and through one or more dewatering press nips in the press section.

The present invention also relates to a paper or board machine comprising a number of successively arranged press zones. In a paper machine, a paper web is transferred into a first one of the press zones as a closed draw from the forming wire in the forming or wire section of the paper machine or a transfer wire onto which the web has been transferred from the forming wire, and the paper web to be pressed is then transferred between the different zones in the press section as a supported and closed draw. The paper web is transferred after a last one of the press zones in the running direction of the web to the dryer section of the paper machine as a closed draw, although it may also be possible to provide an open draw in certain circumstances. If used in a board machine with a board web on the other hand, the board web can be transferred as a closed draw or, in the alternative, as an open draw as desired through each section of the machine.

BACKGROUND OF THE INVENTION

Increased running speeds of paper and board machines provide new problems to be solved, which problems are mostly related to the runnability of the machine. Currently running speeds of up to about 1600 meters per minute are employed in paper machines. At these running speeds, the so-called closed press sections, which comprise a compact combination of press rolls arranged around a smooth-faced center roll, for the most part still operate satisfactorily. As examples of these press sections, reference is made to the current assignee's Sym-Press II™ and Sym-Press O™ press sections.

It is a recognized principle in the art that dewatering taking place by pressing is more advantageous than dewatering by evaporation from the point of view of energy economy. For this reason, attempts are made to remove a maximal amount of water out of the web by pressing, in order that the proportion of water to be removed by evaporation can be made as low as possible. Increased running speeds of paper and board machines, however, provide new, so far unsolved problems expressly for dewatering taking place by pressing because the press impulse applied by such dewatering by pressing, e.g., in press nips, cannot be increased sufficiently by the prior art means, above all because at high speeds the nip times remain insufficiently short and, on the other hand, the peak pressure of the compression in the nip cannot be increased beyond a certain limit without destroying the structure of the web.

With increasing running speeds of paper machines, the problems of runnability of a paper machine are also manifested with higher emphasis, because a web with a high water content and low strength does not endure an excessively high and sudden compression pressure impulse or the dynamic forces produced by high speeds, but rather web breaks and other disturbances in the operation of the paper machine arise and cause standstills. In modern paper machines, the cost of standstill time is today about 50,000 Finnish Marks (FIM) per hour (roughly $11,000 which adds up to significant amounts).

Further drawbacks of the prior art wire parts and press sections include the requirement of suction energy of the suction rolls commonly used in them and the noise problems arising from suction rolls. Moreover, suction rolls with their perforated mantles, inner suction boxes, wearing seals, and other suction arrangements are components with a high cost and which require repeated servicing and consume an abundance of energy. As an example, it can be mentioned that in a board machine having a width of about 6 meters, the cost of suction energy of one suction roll is about 1 million FIM per year ($220,000). In addition to the drawbacks mentioned above, the efficiency of the prior art suction rolls is lowered significantly at particularly high web speeds, because the suction force does not have sufficient time to act upon the web in the intended manner through the long perforations in the relatively thick mantle of the suction roll.

In the prior art press sections, the web is often passed from the forming wire into the first press nip on a pick-up felt, which also operates as a press fabric that receives significant amounts of water in the first press nip, which is either a roll nip or an extended nip. In the first press nip, it is often necessary to employ a relatively high compression pressure and to deal with large quantities of water, and it is one of the drawbacks arising from this that the outer face of the press felt tends to be contaminated and its porous fibrous structure tends to be partially blocked. Attempts are made to prevent this blockage by means of efficient felt conditioning devices, which are, however, quite expensive, spacious components which consume an abundance of energy.

Recently, even speeds as high as about 40 meters per second (2400 meters per minute) have been contemplated as speeds of printing-paper machines. Applications at speeds as high as this, in particular in wide machines, provide ever more difficult problems to be solved, of which problems the most important ones are runnability and adequate dewatering capacity of the machine at a high web speed. Similarly, in board machines (basis weight of the web being greater than about 100 grams per square meter), attempts are made to increase the present web speeds (about 8 to about 15 meters per second) to the level of from about 15 to about 25 meters per second.

Important drawbacks of the press felts used in the prior art press sections include the effect of rewetting the web and the tendency of contamination because, in particular when the press felts run through a high-pressure nip or nips, particles of contaminants tend to be affixed and to adhere to the press fabrics. For this reason, the operation of the press fabrics is disturbed and their cleaning requires efficient conditioning devices, which consume a considerable amount of energy.

Moreover, in high-pressure press nips, the prior art porous press felts are subjected to intensive wear and strain, so that the felts must be replaced rather frequently, which increases the costs to a considerable extent.

With respect to the prior art most closely related to the present invention, the following is stated.

In conventional board machines, a pre-press provided with a fabric circulation of its own has been employed, in which pre-press the linear load is for wires (so-called wire press) of an order of from about 15 kN/m to about 20 kN/m and for press felts from about 40 kN/m to about 50 kN/m. Experience of operation of such conventional board machines has been obtained from wire presses in particular with paper grades having a basis weight higher than about 80 grams per sq.m. Moreover, several different presses operating by means of a pick-up suction roll have been in use, for example, in machines that produce kraft paper. With respect to these and to the rest of the prior art closely related to the present invention, reference is made to the current assignee's Finnish Patent Application No. 905798 and to the corresponding European Patent Application Publication No. 0 487 483 A1 and U.S. Pat. No. 5,389,205 (which is hereby incorporated by reference herein). In FIGS. 6A, 6B and 6C in these applications and the U.S. patent, the use of a so-called wire press nip is illustrated, by means of which wire press nip arranged in connection with the web, the dry solids content of the web is increased from about 10% to about 20%. The wire nips are preferably intended to be nips that remove water in two directions, either as a roll nip provided with two opposite press fabrics (FIG. 6A in these publications), an extended nip provided with an upper press felt (FIG. 6B), or a belt-tensioned nip in which there is an upper press fabric (FIG. 6C), i.e., both web-engaging press fabrics are significantly water-receivable. After the wire nips, the pre-pressed web is passed to the respective pick-up points where it is transferred by means of the suction of the pick-up roll to the lower face of an upper pick-up press felt and then carried thereon into the next nip, which is either an extended nip or a roll nip.

A wire nip arrangement substantially similar to that described above is also described in International Patent Application WO 94/29519 (applicants Valmet-Tampella Inc.), to which publication, reference is made in respect of the prior art.

In the prior art wire presses, it has generally been considered necessary that the dewatering takes place in the wire nips in two directions, i.e., also toward the upper press fabric. An exception from this generality consists of what is called lump breakers, which are used in board machines in the manner known from the prior art and which can also be used without a press fabric. As is known from the prior art, a lump breaker is placed in connection with a wire suction roll to form a wire nip, which increases the dry solids content of the web by just a few percentage units, and the primary function of this roll is to improve the upper surface properties of the board web and to facilitate the threading of the web. Most often, as lump breakers, a smooth roll provided with a resilient rubber coating is used, whose diameter is about 600 to about 800 mm, and the linear load in the nip is maximally about 30 kN/m.

Further, with respect to the prior art related to the present invention, reference is made to European Patent Application Publication No. 0 359 696 A2 in the name of Beloit Corp., in which a roll nip placed in connection with a forming wire is described, which nip is provided with two press felts so that the lower press felt is arranged around a lower press roll situated inside the forming-wire loop and the upper press-suction roll is arranged inside the upper-feet loop. On the upper press-suction roll, the web is transferred from the forming wire onto the lower face of the water-receiving press felt and thereon, further as a horizontal run into the first extended nip, through which the upper press felt runs while it also operates as a press fabric in that nip. In the press sections mentioned above, even if objectives similar to those of the present invention are partly achieved in them, the press-suction roll can, however, not be eliminated, nor can rewetting of the web or the tendency of wear and contamination of the press felt be eliminated, which phenomena are particularly significant drawbacks expressly in press section similar to that described in EP 0 359 696.

OBJECTS AND SUMMARY OF THE INVENTION

Accordingly, it is an object of the present invention to provide novel solutions for the problems discussed above so that the drawbacks in the prior art mentioned above and additional drawbacks that will come out later are substantially avoided.

It is another object of the present invention to provide a method for removing water from a paper web by pressing at high web running speeds, in particular in the case of printing paper at speeds of about 25 to about 40 meters per second, so that the quality properties of the web produced can be kept high and excessively high dynamic forces that cause web breaks are not applied to the web. Similarly, in board machines for manufacturing board webs, owing to the present invention, attempts are made to increase the web speeds to the speed range of about 15 to about 25 meters per second mentioned above.

Even though one of the principal objects of the present invention is to permit increased running speeds of both paper and board machines, this is not always an indispensable aim of the invention, but the advantages provided by the invention can, if necessary, be realized in paper and board machines that use current normal web running speeds also in the form of reduced consumption of energy by reducing the number of suction rolls, by eliminating some of the suction rolls, or by increasing the dry solids content of the web after the press section, in which case the proportion of dewatering taking place by evaporation can be reduced and, at the same time, the runnability and the efficiency of operation of the paper machine can be increased (fewer web breaks).

It is still another important object of the invention to provide a method and press section of the type concerned by whose means a paper or board can be produced having surfaces with improved smoothness properties.

In view of achieving the objects stated above and others, and in order to avoid the problems mentioned above, in the method in accordance with the invention the web that runs on the forming wire in the forming section or a transfer wire (e.g., having been transferred thereto from the forming wire) is made to adhere in a transfer and pre-press zone to the outside face of a transfer belt which is substantially non-water-receiving, and after the pre-press zone, the web is separated substantially immediately from the forming or transfer wire and passed on support of the transfer belt onto the next press fabric in the press section and/or into the next press nip.

The press section in accordance with the invention includes a pre-press zone or zones and a transfer belt which is substantially non-water-receiving, is guided in a loop and has an outer face capable of causing adhesion of the paper web thereto. The transfer belt is passed through the pre-press zone, or if two zones are present, at least through the latter zone, and in that pre-press zone, the paper web is made to adhere to the outside face of the transfer belt thereby effecting transfer of the web from the forming wire or transfer wire to the transfer belt. After that zone, the web is separated substantially immediately from the forming wire or equivalent without substantial rewetting of the web, and on the transfer belt, the web is passed as a closed and supported draw onto the next press fabric in the press section and/or through the next press zone (or possibly as an open draw in a board machine).

In the present invention, a reliable and closed transfer of the web from the former section to the dryer section is accomplished without risk of rewetting of the web. Also, if necessary, in the invention, in connection with the forming wire or an equivalent transfer wire, it is possible to arrange one or more pre-press zones on which the web is made to adhere reliably to the transfer belt which substantially does not receive water, which belt is an essential component in the invention and is described in greater detail below. Moreover, a substantial amount of water is removed which increases both the dry solids content and the wet strength of the web. This again improves the runnability of the press section and facilitates later stages of dewatering.

The transfer belt in accordance with the invention is not susceptible to wear and contamination to the same extent as a conventional porous press felt and also, the transfer belt in accordance with the invention tolerates even efficient cleaning more readily, such as cleaning by means of high-pressure water jets or doctors.

In a preferred embodiment of the invention, in the pre-press and transfer zone, the dewatering takes place only in one direction, preferably downwards, whereby the treatment and further draining of the relatively large quantities of water removed in the pre-press zone or zones are promoted. This uni-directional dewatering results from the non-water-receiving property of the transfer belt passing through the pre-press and transfer zone on one side of the web.

By means of the method and press section of the present invention, it is possible to achieve improved properties of smoothness of the faces of the paper or board produced, which is partly based on the use of a relatively smooth-faced transfer belt applied and arranged as per the invention in an appropriate process stage.

In another embodiment of the invention, the pre-press zone is arranged in conjunction with the forming wire and comprises an extended nip defined by an extended nip roll, e.g., a roll having a hose mantle and a press shoe arranged in a loop of the hose mantle, and a smooth-faced roll in opposed relationship to the extended nip roll. Either the extended nip roll or the smooth-faced roll may be arranged in a loop of the forming wire and the other roll arranged in a loop of the transfer belt.

In the following, the invention will be described in detail with reference to some exemplifying embodiments of the invention illustrated in the figures in the accompanying drawings. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
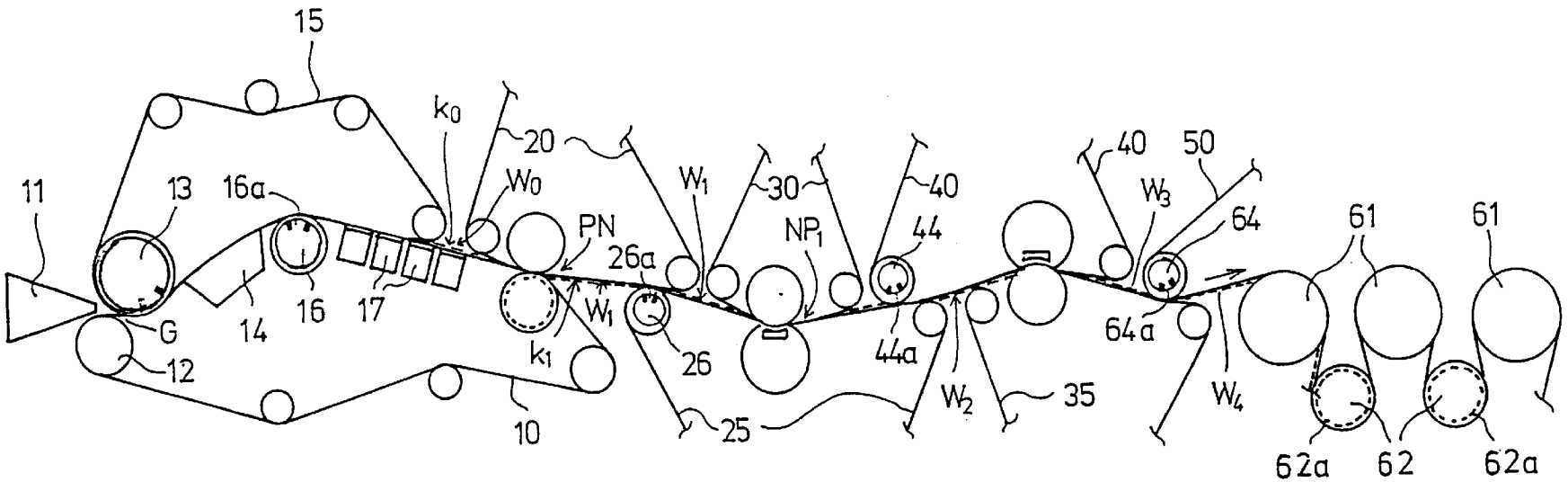
FIG. 1 is a schematic side view of a wet end of a paper machine that makes use of a press section in accordance with the invention and the connection of the wet end with an initial end of a dryer section.

Referring to the accompanying drawings wherein the same reference numerals refer to the same or similar elements in FIGS. 1–11, FIGS. 1–4 illustrate press sections in accordance with the invention intended in particular for different paper grades and FIGS. 5–11 illustrate press sections mainly intended for boards (basis weight from about 100 to about 400 grams per sq.m) and details of such press sections. However, it should be emphasized that many details of the press sections shown in FIGS. 1–4 are also suitable for use with board webs, and the press sections shown in FIGS. 5–11 are also suitable for use with different paper grades. Moreover, features shown in the press section constructions of FIGS. 1–4 can be used in conjunction with the press section constructions shown in FIGS. 5–11 and vice versa.

FIG. 1 is a schematic illustration of an exemplifying embodiment of the overall arrangement of a paper machine that makes use of a press section in accordance with the present invention. FIG. 1 shows the twin-wire gap former of the paper machine, in which former there is a lower forming wire 10 and an upper wire 15, a headbox 11 of the paper machine which feeds a pulp suspension jet into a forming gap G defined by a convergence of the wires 10,15. The forming gap G is defined between the runs of the wires 10,15 guided by a breast roll 12 arranged in a loop of the lower wire 10 and by a forming suction roll 13 placed inside a loop of the upper-wire loop 15. In this exemplifying embodiment, the curved twin-wire forming zone placed on the forming roll 13 is first followed by a forming shoe 14 provided with a ribbed deck and after that by a second forming suction roll 16 having a suction zone 16a on which the twin-wire zone is curved from an upwardly inclined direction to a downwardly inclined direction. After this, inside the lower-wire loop, there are suction boxes 17, of which the last box or boxes separate the web $W_0$ from the upper wire 15 so that the web is carried on only the forming wire over at least a portion of the last suction box 17. After this separation from the upper wire 15, the web $W_0$ follows the lower wire 10 as a generally downwardly inclined run into a pre-press zone PN in accordance with the invention. After the twin-wire zone, the dry solids content $k_0$ of the web $W_0$ is typically of an order of about 10%.

In addition to the wet wire, i.e., the lower forming wire 10, an upper transfer belt 20 also runs through the pre-press zone PN. Transfer belt 20 is arranged in accordance with the invention and does not receive a substantial amount of water so that in the pre-press zone PN, the draining of water takes place in only one direction, namely, primarily downwards into and through the forming wire 10, i.e., in the direction of the force of gravity, which facilitates the treatment and further draining of the large quantities of water to be removed in this zone. Moreover, the outer face of the transfer belt 20 is relatively smooth and even in other respects provided with such adhesion properties that the web $W_1$ is transferred to the transfer belt in the pre-press zone PN and separated from the forming wire 10 substantially without rewetting immediately after the pre-press zone PN and thereafter runs on support of the transfer belt 20 substantially along a straight downwardly inclined run. Other properties of the transfer belt in accordance with the invention are discussed below.

In the pre-press zone PN, water is removed to such an extent that the dry solids content of the web $k_1$ is increased ($\Delta k=k_1-k_0$) through the pre-press zone PN by about 7 to about 10 percentage units. The linear load present in the pre-press zone PN is selected in a range of from about 25 kN/m to about 400 kN/m, preferably in a range of about 40 kN/m to about 250 kN/m. In other embodiments, the dry solids content is increased by virtue of its passage through the pre-press press zone by about 2 to about 12 percentage units and more preferably from about 4 to about 8 percentage units.

From the transfer belt 20, the web $W_1$ is transferred by causing it to adhere to a lower press felt 25 on a suction zone 26*a* of a transfer suction roll 26. On the lower felt 25, the web W is transferred through an extended-nip zone including an extended nip $NP_1$ placed after the first pre-press zone thereby substantially dewatering the web. An upper felt 30 also runs through the extended nip $NP_1$ so that, in the extended nip $NP_1$, dewatering of the web takes place in two directions, i.e., through both faces of the web.

As shown in FIG. 1, the web $W_2$ is transferred after the extended nip $NP_1$ from the lower felt 25 onto an upper felt 40 about a suction zone 44*a* of a transfer suction roll 44. On the lower face of the upper felt 40, the web $W_2$ is transferred through the second extended-nip zone including an extended nip $NP_2$. After the second extended-nip zone, the web $W_3$ is made to adhere to a smooth-faced second transfer belt 35, which is preferably constructed so that it substantially does not receive water, and the web is transferred on the belt onto a drying wire 60 on a suction zone 64*a* of a transfer suction roll 64. Thereafter, the web $W_4$ has a dry solids content $k_4$ of about 42% to about 55% and is passed over steam-heated drying cylinders 61. In gaps between the drying cylinders 61 situated in an upper row, there are reversing suction cylinders 62 which are provided with a hollow face 62*a* subjected to a vacuum and are situated in a lower row below the upper row of drying cylinders. As shown in FIG. 1, the run of the web from the former section to the dryer section is highly linear so that its largest angle of change in direction is smaller than about d<30°. Moreover, from the former section to the drying wire 60, the web has a fully closed and supported draw which is, moreover, accomplished without a major risk of rewetting of the web.

In the following, different embodiments and features of construction of the end portion of the wire part and the press section, which have been illustrated in FIG. 1 generally, will be described in more detail with reference to FIGS. 2–4. FIGS. 13–15B also show different features which may be incorporated into the press sections disclosed herein, e.g., that shown in FIG. 1.

Figure 2:
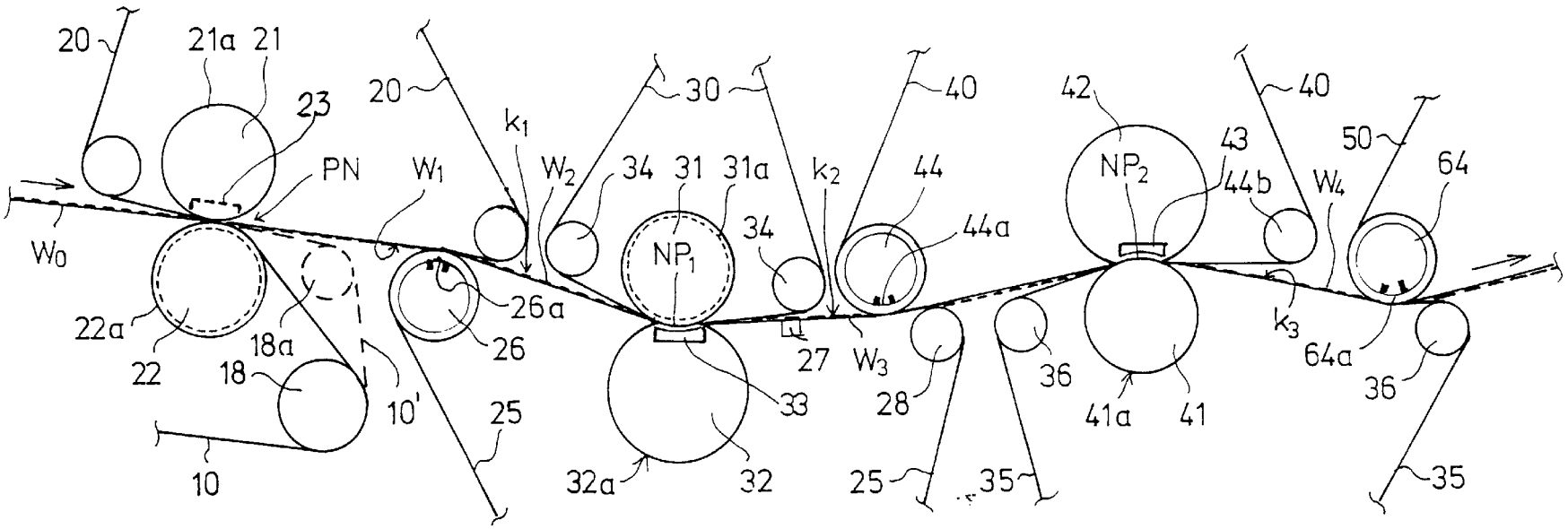
FIG. 2 shows an embodiment of a press section in accordance with the invention primarily intended for printing papers and fine papers.

As shown in FIG. 2, the pre-press zone PN is formed between a press roll 21 provided with a smooth cylinder face 21*a* or an equivalent extended-nip roll arranged inside the loop of the transfer-belt 20 and a lower roll 22. The extended-nip roll alternative is illustrated in FIG. 2 by the press shoe 23 shown by dashed lines inside the roll 21 (and is shown in FIGS. 13–15B and described in greater detail with reference to thereto). The lower roll 22 in the pre-press zone PN, which roll is placed inside the loop of the forming wire 10, is a hollow-faced 22*a* press roll. In the position of this roll 22, in an exceptional case, there may also be a suction roll. In FIG. 2, the dashed line illustrates such a run 10' of the forming wire after the pre-press zone PN as is guided by an optional guide roll 18*a*. This alternative construction has advantages discussed below with respect to FIGS. 15A and 15B. By means of this arrangement, the transfer of the web $W_1$ onto the lower face of the transfer belt 20 is promoted. The drive roll of the forming wire 10 is denoted by the reference numeral 18.

In the press section shown in FIG. 2, the first press zone after the pre-press zone PN is an extended nip $NP_1$ having a press zone through which two water-receiving press fabrics 25 and 30 run. The lower roll in the extended-nip zone $NP_1$ is a hose roll 32 provided with a press shoe 33, and the upper roll is a hollow-faced 31*a* press roll 31. The outside face of a hose mantle 32*a* of the press roll 32 can be hollow-faced or smooth. In some cases, the extended-nip zone $NP_1$ can be substituted for by a corresponding roll nip. The web $W_3$ is arranged to follow the lower felt 25 after the extended-nip zone $NP_1$, which conveyance is guaranteed or at least assisted by means of a suction box 27. After the suction box 27, the dry solids content $k_2$ of the web is typically from about 32% to about 47%, whereas, before the extended-nip zone $NP_1$, the dry solids content $k_1$ of the web W is typically from about 16% to about 25%.

Further, the web $W_3$ is separated from the lower fabric 25 on the suction zone 44*a* of the transfer suction roll 44, on which zone the web is transferred onto the upper fabric 40 which runs through the second extended-nip zone $NP_2$ as the upper fabric of the zone. The lower fabric in the second extended-nip zone $NP_2$ is preferably a transfer belt 35 that substantially does not receive water, and owing to the surface properties of the belt, the web $W_4$ is transferred after the extended-nip zone $NP_2$ at a location before the guide roll 44*b* of the upper felt 40, onto the drying wire 60 while aided by the vacuum present in a suction zone 64*a* of a transfer suction roll 64 arranged inside the loop of the wire 60. After the second extended-nip zone $NP_2$, the dry solids content $k_3$ of the web $W_4$ is typically from about 42% to about 55%. The upper roll 42 in the extended-nip zone $NP_2$ is a hose roll in whose interior there is a pressure-loaded press shoe 43, and the lower roll is a smooth-faced or hollow-faced 41*a* press roll 41, which can be a variable-crown roll if necessary. In certain cases, instead of an extended-nip zone $NP_2$, it is also possible to use a roll nip, and instead of a transfer belt 35, it is possible to use a water-receiving press fabric, so that in the nip zone $NP_2$, the dewatering can take place in two directions.

Figure 3:
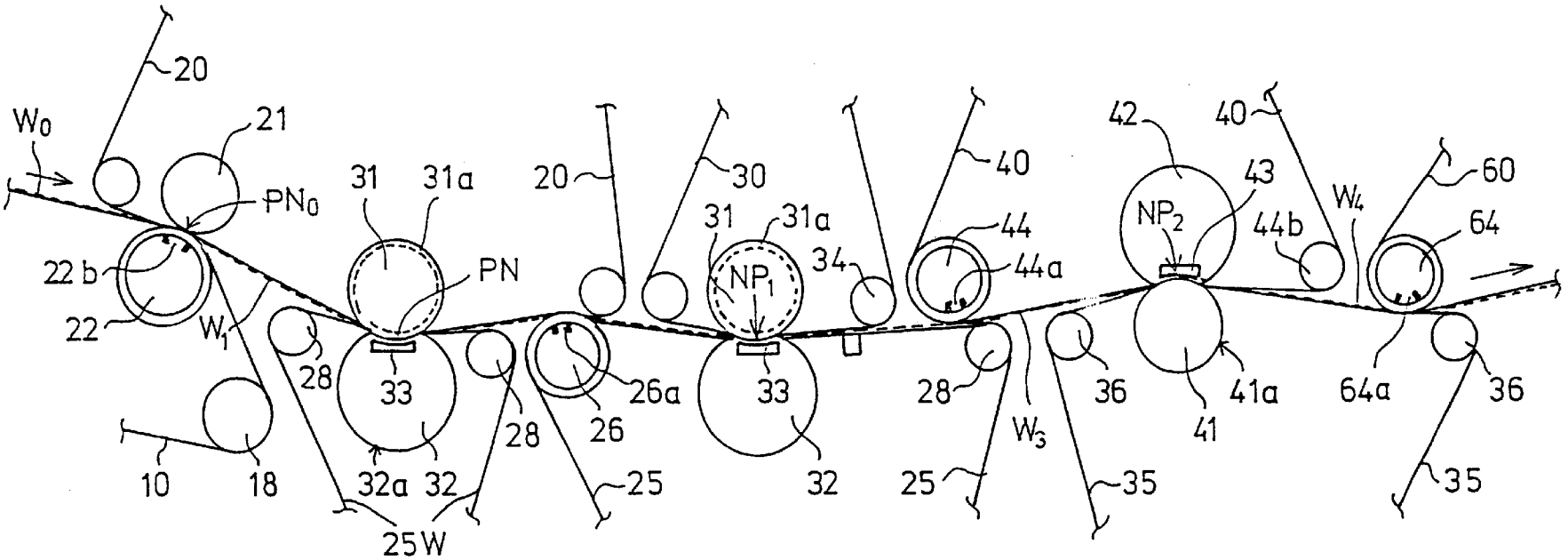
FIG. 3 shows a press section in accordance with the invention which is intended in particular for thicker paper grades and/or for particularly high-speed machines and in which there are three extended-nip zones besides a wire pre-press zone.

The press section shown in FIG. 3 differs from the press section shown in FIG. 2 in the respect that in connection with the forming wire 10, there is no pre-press nip proper, but in connection with the suction zone 22*b* of the wire suction roll 22, there is a web adhering nip $PN_0$ formed by a small-diameter press roll 21. In the web adhering nip, the linear load is low, typically of an order of from about 15 kN/m to about 40 kN/m. By means of the adhering nip $PN_0$, it is ensured that directly after the nip the web $W_1$ is separated from the forming wire 10 and follows the transfer belt 20 that does not receive water. On the belt 20, the web $W_1$ is passed into the first pre-press nip PN proper. As the pre-press nip PN, an extended-nip zone is used, in which the lower roll 32 is a hose roll which is provided with a pressure-loaded press shoe 33. In the pre-press zone PN, the lower fabric is a pre-press wire 25W, instead of a press felt, which wire 25W has a relatively open and permeable fiber structure and which can be kept clean readily. The mantle of the hose roll 32 is preferably provided with a relatively open hollow face, such as grooves 32*a*. The upper roll in the pre-press zone PN is a hollow-faced 31*a* press roll 31*e* which can, if necessary, be a variable-crown roll provided with a press shoe 33 in view of control of the cross-direction compression pressure profile. In respect of the extended-nip zones $NP_1$ and $NP_2$ placed after the pre-press zone PN, the construction is similar to that described above in relation to FIG. 2.

Figure 4:
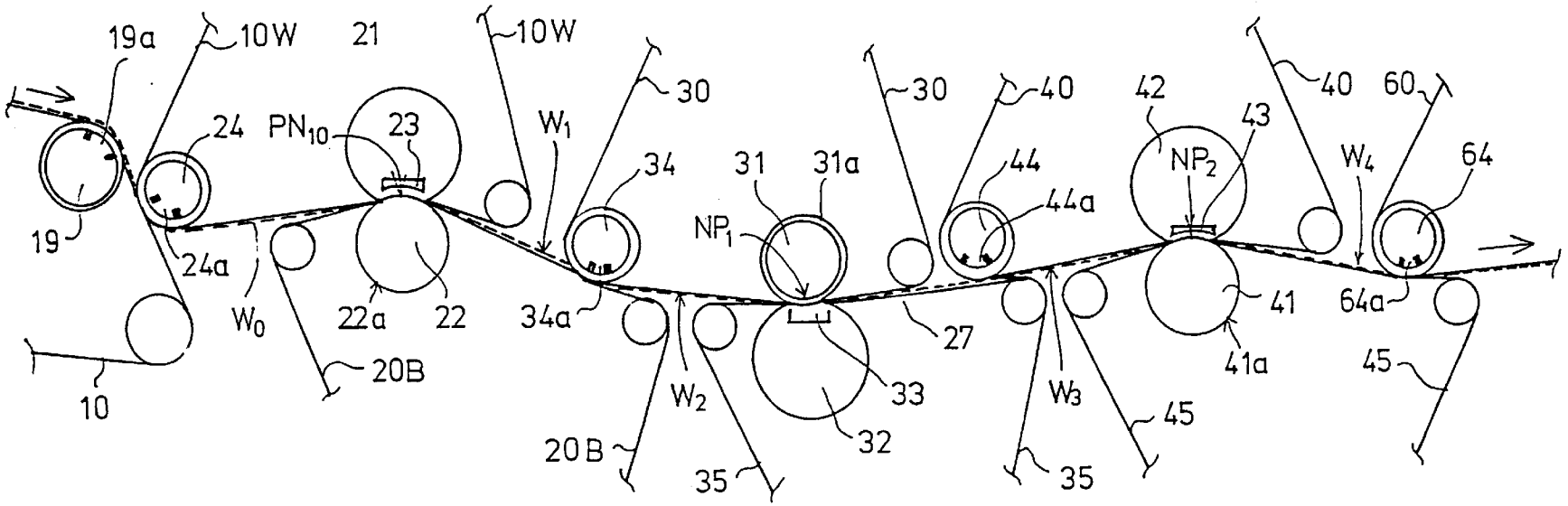
FIG. 4 shows an embodiment of the invention in which the pre-press nip is arranged after the former section and separate from the former section.

The embodiment of the invention shown in FIG. 4 differs from that shown in FIG. 3 in the respect that in FIG. 4, in connection with the forming wire 10 proper, there is no wire nip at all, but after the normal wire suction roll 19 provided with a suction zone 19*a*, the web $W_0$ is transferred on the suction zone 24*a* of the pick-up roll 24 onto a pre-press wire 10W of a relatively open and permeable fiber structure. The web $W_0$ is transferred on the lower face of the wire into the first pre-press zone $PN_{10}$ proper. Through this pre-press zone PN a lower transfer belt 20B runs which substantially does not receive water. The upper roll in the pre-press zone PN is a hose roll 21, in which there is a pressure-loaded press shoe 23, and the lower roll 22 is a smooth-faced or hollow-faced 22*a* press roll. From the lower transfer belt 20B, the web $W_1$ is transferred on the suction zone 34*a* of the transfer suction roll 34 onto the upper felt 30 which operates as the upper fabric in the first extended-nip zone $NP_1$ after the pre-pressing. After the extended-nip zone $NP_1$, the web $W_2$ is transferred, aided by a suction box 27 if necessary, onto the lower fabric 35 and from it further onto the upper felt 40 on the suction zone 44*a* of the transfer suction roll 44. On the upper fabric 40, the web runs through the second extended-nip zone $NP_2$, after which the web $W_4$ is separated onto the transfer belt 45 on which it is passed onto the drying wire 60. In certain cases, if necessary, one or both of the extended nips $NP_1$ and $NP_2$ can be substituted for by a corresponding roll nip, and instead of the transfer belt 45, it is possible to use a press felt substantially receiving water, and instead of the press felt 35, it is possible to use a non-water-receiving transfer belt.

The embodiment of the invention shown in FIG. 4 is not in all respects as favorable as the embodiment shown in FIGS. 1–3 because, when a pre-press and transfer wire 10W separate from the forming wire and a separate pre-press zone $PN_{10}$ are used, the overall length of the press section is increased and, moreover, it is necessary to use a pick-up suction roll 24. Nevertheless, the use of a pick-up felt proper and the drawbacks arising from it, such as tendency of contamination, are avoided.

The pre-press zone $PN_{10}$ may also be formed as shown in FIGS. 13–15B described below wherein the pre-press and transfer wire 10W is equivalent to the forming wire 10.

Figure 5:
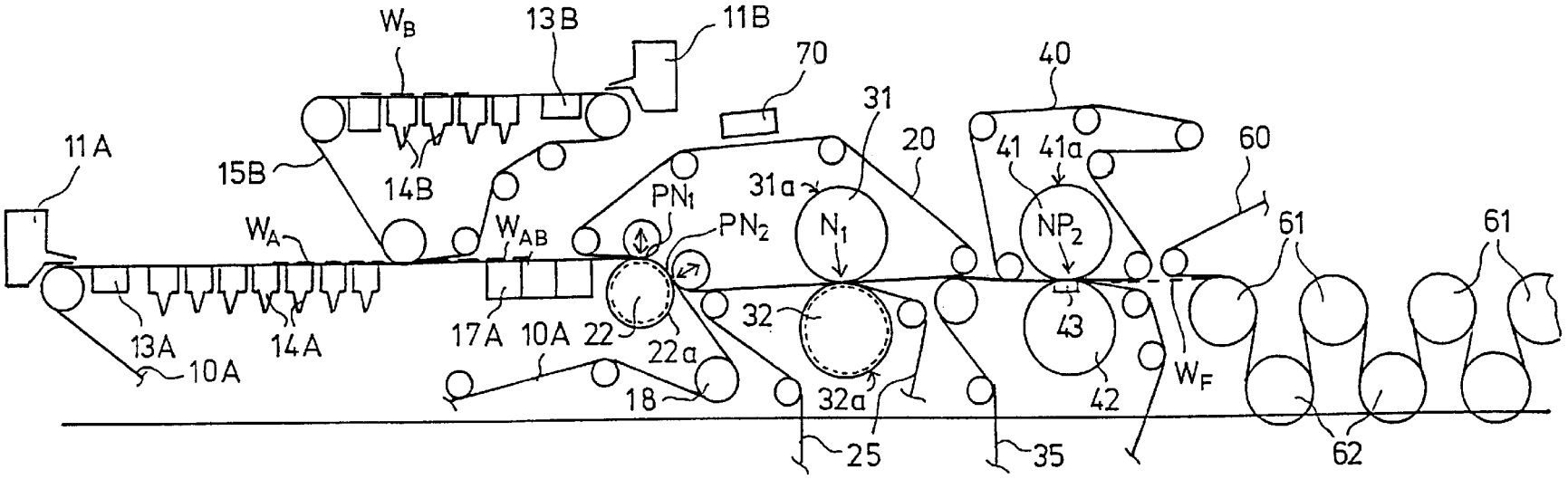
FIG. 5 shows a former section of a board machine and a press section in accordance with the present invention arranged in connection with the forming section.

FIG. 5 shows, by way of example, an embodiment of a press section in accordance with the invention in connection with a board machine and with its multi-layer web former. As shown in FIG. 5, the web former of the board machine comprises a lower wire 10A, onto which a headbox 11A feeds a pulp suspension jet. After the slice part of the headbox 11A, there follows a horizontal fourdrinier wire part in which there is first a forming board 13A followed by web suction boxes 14A. The component web $W_A$ thus partially formed is combined with a component web $W_B$ formed by means of the upper-wire unit. The upper-wire unit comprises a headbox 11B which feeds a pulp suspension jet onto an upper wire 15B. On the horizontal initial portion of the upper wire 15B, there is first a forming board 13B which is followed by wet suction boxes 14B. The component webs $W_A$ and $W_B$ are combined into a combination web $W_{AB}$ which is passed on the lower wire 10A over dry suction boxes 17A into the press section in accordance with the invention.

To wit, after the dry suction boxes 17A, the web $W_{AB}$ is passed on the lower wire 10A through two pre-press nips $PN_1$ and $PN_2$ in accordance with the invention. The lower roll of these pre-press nips $PN_1$ and $PN_2$ is a press roll 22 which is arranged inside the loop of the lower wire 10A and which has an open hollow outer face 22*a* that receives water, and is further possibly provided with a shrink-wire sock. In accordance with the invention, a transfer belt 20 that substantially does not receive water is arranged to run through the pre-press zones $PN_1$ and $PN_2$, which belt transfers the board web into the first press nip $N_1$ proper. The nip $N_1$ is a roll nip having a nip zone which is extended by using press rolls 31 and 32 of relatively large diameters. Of the press rolls, the upper roll 31 is a smooth-faced 31*a* press roll, and the lower roll is a press roll provided with an open hollow face 32*a*. Through the nip $N_1$, a relatively thick lower felt 25 runs which receives an abundance of water. In the nip $N_1$, the dewatering takes place in one direction, as it does in the pre-press nips $PN_1$ and $PN_2$, because the transfer belt 20 substantially does not receive water. After the nip $N_1$, the board web follows the transfer belt 20, based on its adhesion properties, after which the board web is transferred onto the second lower felt 35 which carries the board web through the extended-nip zone $NP_2$. Through the extended-nip zone $NP_2$, the lower felt 35 and the water-receiving upper felt 40 run. The upper roll in the extended-nip zone $NP_2$ is a hollow-faced press roll 41 and the lower roll is a hose roll 42 in which there is a pressure-loaded press shoe 43. After the nip zone $NP_2$, the board web is passed as an open draw $W_F$ onto the drying wire 60. The open draw $W_F$ is possible because, owing to efficient dewatering, the board web has a sufficiently high strength after the nip $NP_2$ vis-a-vis preventing web breaks. On the drying wire 60, the board web is passed over the contact drying cylinders 61 and reversing suction cylinders 62.

FIG. 5 schematically shows belt conditioning devices 70 in connection with the transfer belt 20. By means of the devices 70, the outer face of the transfer belt 20 is kept clean. The devices 70 can include doctors, high-pressure water jets and/or other, equivalent conditioning devices in themselves known, which are placed in different locations along the circulation looping of the transfer belt loop 20. Owing to the non-porous structure, substantially non-water-receiving construction and the smooth face of the transfer belt 20,20A, 20B, the transfer belt tolerates even a high press-nip loading and even highly efficient cleaning substantially better than corresponding porous press felts. Devices similar to the conditioning devices 70 may of course be provided in all the embodiments of the belt circulations illustrated in the figures, in which illustrations the devices 70 are yet not shown or described to avoid unnecessary repetition.

Figure 6:
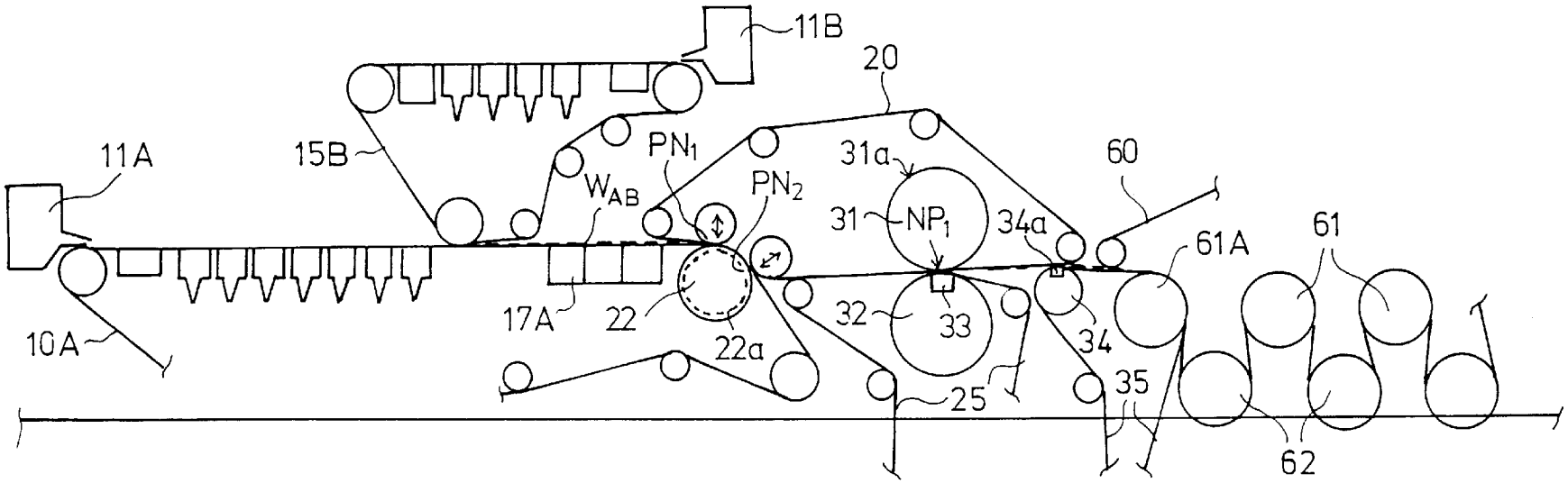
FIG. 6 is an illustration similar to FIG. 5 of a board machine and a second press section of the same in accordance with the invention.

FIG. 6 shows an alternative embodiment of a press section in accordance with the invention for a board machine. With respect to the multi-layer web former 10A–17A, 11B–15B and the pre-press zones $PN_1$ and $PN_2$, the construction is similar to that shown in FIG. 5. However, unlike the press section shown in FIG. 5, in the press section of FIG. 6 there is just one press nip proper, i.e., the extended nip $NP_1$ through which the transfer belt 20 runs. The lower fabric in the extended nip $NP_1$ is a press felt 25 which receives a large amount of water and which has a relatively high basis weight, preferably about 1500 to about 2000 grams per sq.m. After the extended-nip zone $NP_1$, the board web follows the transfer belt 20 on the basis of its adhesion properties, and the board web is transferred onto the transfer fabric 35 by the effect of the vacuum in the suction zone 34*a* of the transfer suction roll 34. Inside the loop of the fabric 35, a lead-in cylinder 61A is arranged and has a turning sector on which the board web is transferred from the fabric 35 onto the drying wire 60.

Figure 7:
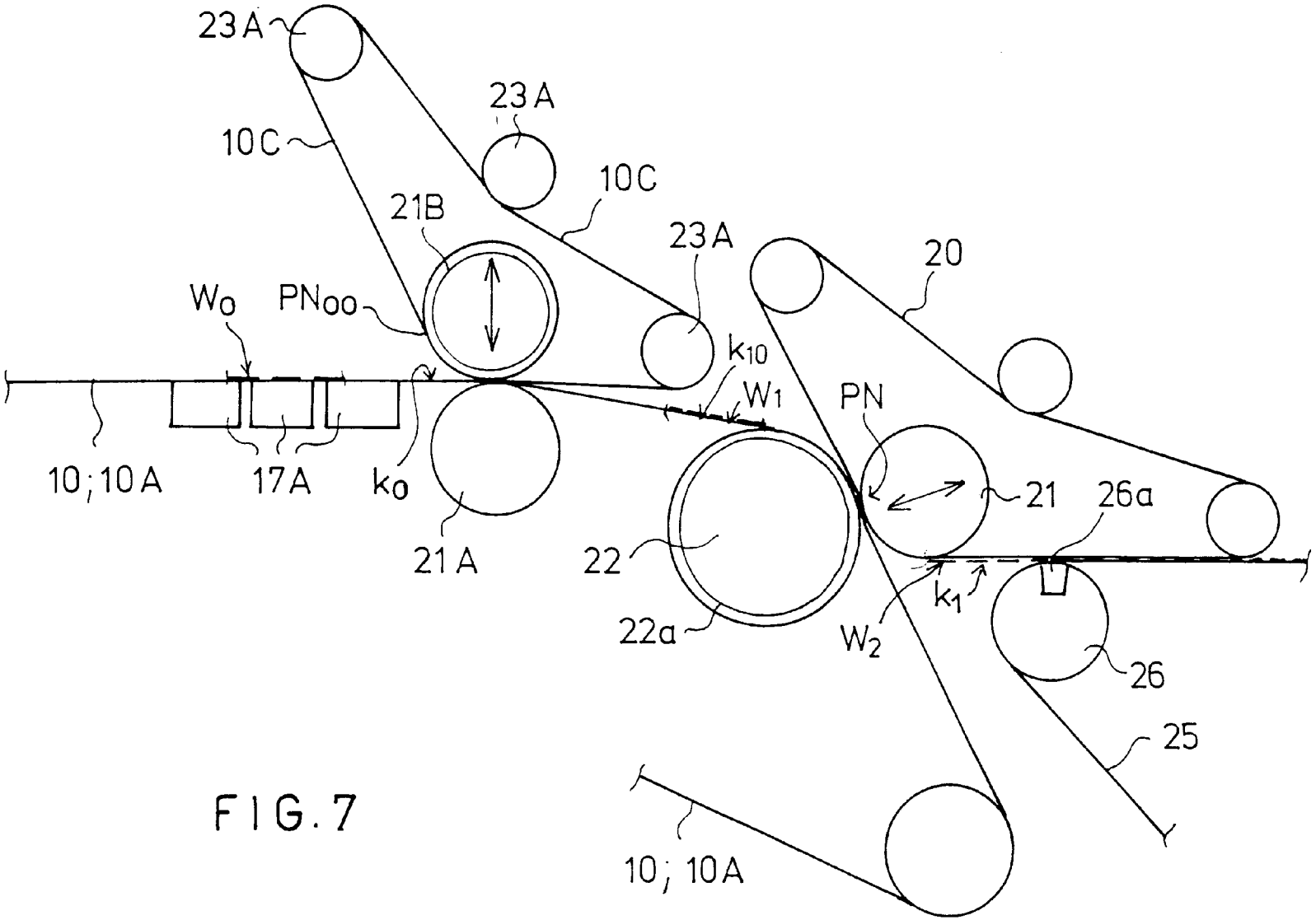
FIG. 7 shows a press section in accordance with the invention which is primarily suitable for boards, in which press section there are two separate wire pre-press nips arranged in connection with the forming wire.

FIG. 7 shows an alternative embodiment (in particular meant for board) for embodiments of wire press nips in a press section in accordance with the invention. As shown in FIG. 7, the board web $W_0$, which may also be a paper web, is brought into the first pre-wire nip $PN_{00}$. The lower roll 21A in this nip $PN_{00}$ is a solid-mantle roll (hardness of about 100 to about 150 P&J), and the upper roll 21B is a roll with an open face, which is coated, for example, with a wire sock. Into the pre-wire nip $PN_{00}$, in addition to the forming wire 10,10A, an upper press wire 10C is passed and is guided in a loop by guide and tensioning rolls 23A. In the pre-wire nip $PN_{00}$, the dry solids content of the web $W_0$, which is typically $k_0$ from about 12% to about 18%, is raised to the level of $k_{10}$ from about 16% to about 22%. After the pre-wire nip $PN_{00}$, the web $W_1$ follows the forming wire 10,10A into the second transfer and pre-press zone PN, which is arranged between the wire turning roll 22 situated inside the loop of the forming wire 10,10A and provided with an open face 22*a* and the press roll 21 situated inside the loop of the transfer-belt 20. The line pressure present in the first pre-wire nip $PN_{00}$ is maximally of an order of about 70 kN/m and in the pre-press nip PN proper, the line pressure is maximally of an order of about 100 kN/m. As the smooth-faced roll 21 in the pre-press nip PN proper, preferably a rubber-coated roll is used whose surface hardness is of an order of about 50 P&J. On the transfer belt 20, the web $W_2$ is transferred onto the lower felt 25 with the aid of the suction zone 26*a* of the suction transfer roll 26.

Differing from the press sections shown in FIGS. 5 and 6, in FIG. 7, the transfer belt 20 does not run through the other press zones except through the pre-press zone PN proper. On the lower felt 25, the web $W_2$ is transferred into the next press nip (not shown). The press section placed after the pre-press section as shown in FIG. 7 can be accomplished by means of one or more roll nip(s) and/or extended nip(s), for example by making use of press and web-transfer arrangements substantially similar to those illustrated above in FIGS. 1–6.

Figure 8:
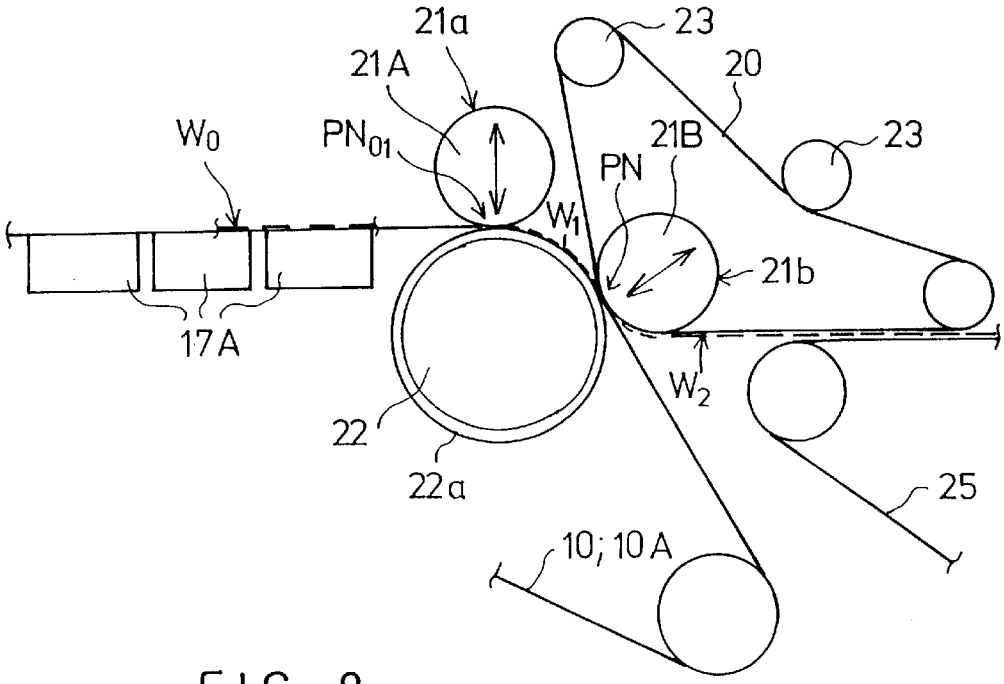
FIG. 8 shows a modification of the press section shown in FIG. 7 and an embodiment of a pre-press section provided with two separate wire press nips.

FIG. 8 shows a pre-press arrangement in which the paper or board web $W_0$ is brought on the forming wire 10,10A over the dry suction boxes 17A into the first pre-press zone $PN_{01}$ which is formed between the upper roll 21A and the lower roll 22. The upper roll 21A is a smooth-faced 21*a* press roll (hardness of from about 100 to about 150 P&J) and the lower roll 22 is an open-faced 22*a* roll, for example a roll coated with a wire sock or a grooved roll. As the lower roll 22, it is also possible to use a suction roll, whose suction zone extends over the nip $PN_{01}$. This suction zone does not, however, extend to the area of the pre-press nip PN proper, whereby the transfer of the web $W_1$ onto the transfer belt 20 is ensured. In the pre-press nip $PN_{01}$, the press load is maximally of an order of about 70 kN/m. It is a particular feature, differing from the above, of the first pre-press nip $PN_{01}$ shown in FIG. 8 that the forming wire 10,10A only passes through this press zone. After the nip $PN_{01}$, the web $W_1$ follows the forming wire 10,10A on which it is passed into the second pre-press nip PN proper. The transfer felt 20 runs through the nip PN which is arranged in accordance with the invention and which substantially does not receive water. After the nip PN, the web $W_2$ is directly detached and separated from the forming wire 10,10A and transferred on the face of the transfer belt 20, based on its adhesion properties, onto the first lower felt 25 of the press section. The press roll 21B of the pre-press nip PN, placed inside the transfer belt 20, is a solid-mantle 21*b* press roll. In the pre-press nip PN, a linear load of maximally about 100 kN/m is employed. A backup roll common of the pre-press nips $PN_{01}$ and PN is a press roll 22 of relatively large diameter, which is provided with an open face 22*a* and which has no suction.

Figure 9:
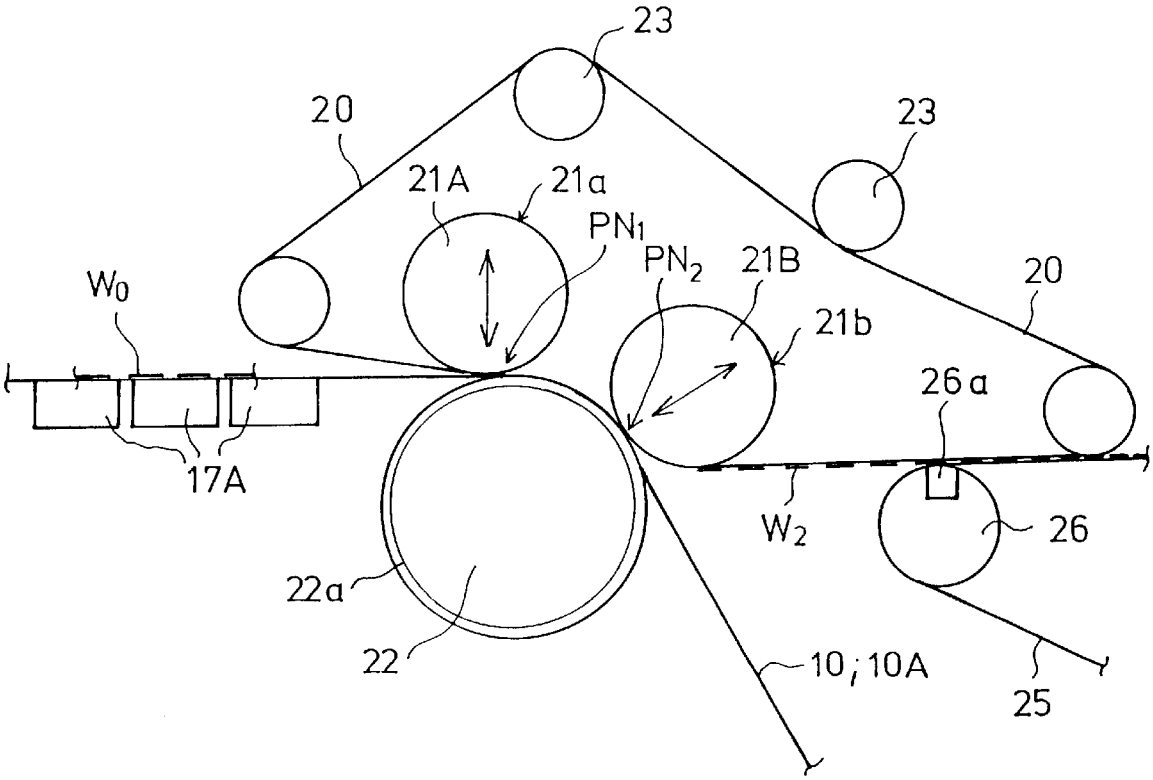
FIG. 9 shows a two-nip pre-press section similar to those shown in FIGS. 5 and 6.

The press section shown in FIG. 9 differs from that shown in FIG. 8 in the respect that, while being guided by guide and tensioning rolls 23, the transfer belt 20 is arranged to pass through two pre-press zones $PN_1$ and $PN_2$. The upper roll 21A in the first pre-press zone $PN_1$ is a solid-mantle roll which is provided with a resilient, for example, rubber coating 21*a* and whose hardness is of an order of about 100 to about 150 P&J. The upper roll 21B in the latter pre-press zone $PN_2$ is a solid-mantle 21*b* roll which is provided with a resilient, for example, rubber coating and whose hardness is of an order of about 50 P&J. In the first pre-press zone $PN_1$, a line pressure of maximally about 70 kN/m is employed, and in the latter press zone $PN_2$, a line pressure of maximally about 100 kN/m. After the latter pre-press zone $PN_2$, the web $W_2$ is transferred on the lower face of the transfer belt 20 onto the first lower press felt 25 by means of the suction zone 26*a* of the transfer suction roll 26. After this, the press section of FIG. 9 can be substantially similar to that shown in FIGS. 1–7 and described above.

Figure 10:
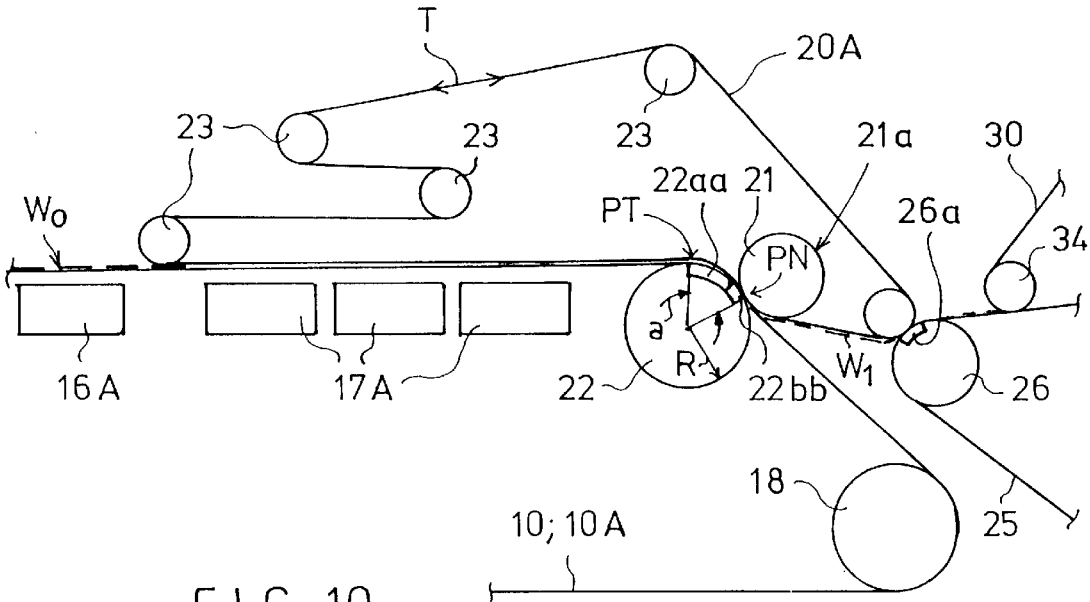
FIG. 10 shows a pre-press section in which there is a pre-press roll nip and preceding belt-tensioned press zone arranged in connection with a wire suction roll.
Figure 11:
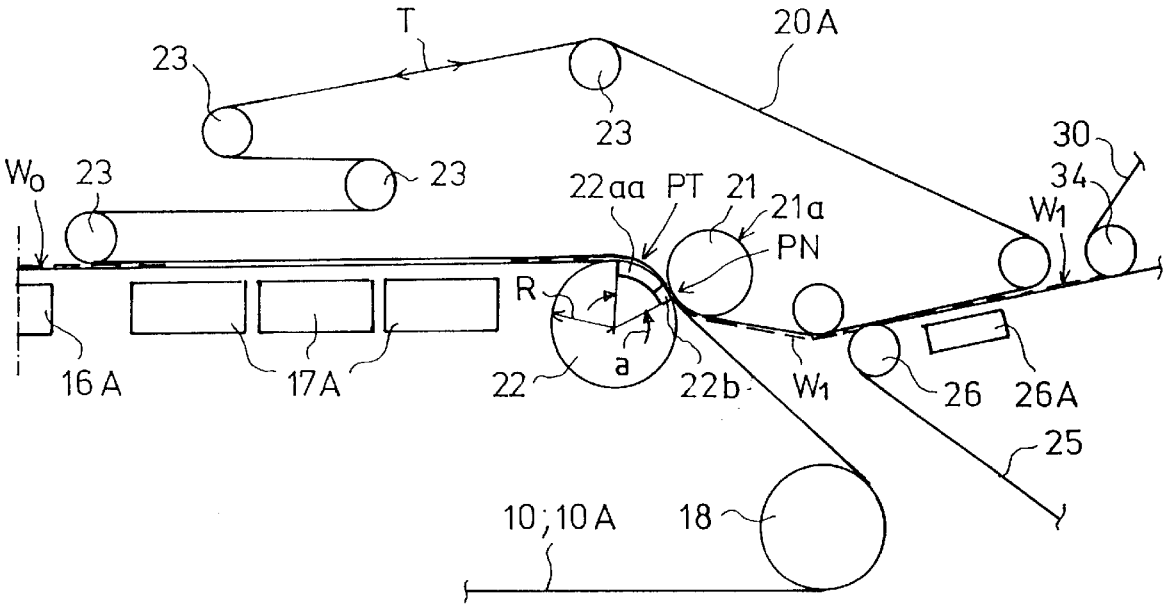
FIG. 11 shows a modification of the press section shown in FIG. 10.

As shown in FIGS. 10 and 11, the pulp web $W_0$ arriving on the forming wire 10,10A is passed after the wet suction boxes 16A into engagement with a lower surface of a transfer belt 20A substantially non-water-receiving. Between the parallel joint runs of the transfer belt 20A and the forming wire 10,10A, the pulp web $W_0$ runs over a group of dry suction boxes 17A, in which connection the transfer belt 20A intensifies the suction effect of the dry suction boxes 17A. After this, the forming wire 10,10A and the transfer belt 20A are curved over the sector a over the suction zones 22*aa* and 22*bb* of the wire suction roll 22. In the press zone of this sector a, whose magnitude is preferably from about 25° to about 80°, water is drained out of the web $W_0$ downwards through the forming wire 10,10A by the effect of suction and partly by the effect of the tensioning pressure (P=T/R) of the transfer belt 20A, wherein T is the tightening tension (N/m) of the transfer belt and R is the radius of the transfer suction roll 22. The belt-tensionpressured press zone PT is followed by a pre-press and transfer nip PN which is formed between the wire suction roll 22 and a press roll 21 provided with a smooth, resilient if necessary, outer mantle 21*a*. In this pre-press nip PN considerable amounts of water are transferred with the aid of the vacuum in the latter suction zone 22*bb* of the transfer suction roll 22 further through the forming wire 10,10A in one direction and downward, i.e., in the direction of the force of gravity. In the pre-press nip PN, the web $W_0$ is also made to adhere to the smooth lower face of the transfer belt 20A and is passed on the transfer belt 20A onto the lower press felt 25, to which the web is made to adhere by means of a suction roll 26 (FIG. 10) or by means of a suction box 26A (FIG. 11). From the lower felt 25 or equivalent transfer belt, the web $W_1$ is transferred after the reversing roll 34 onto the upper fabric 30.

Figure 12:
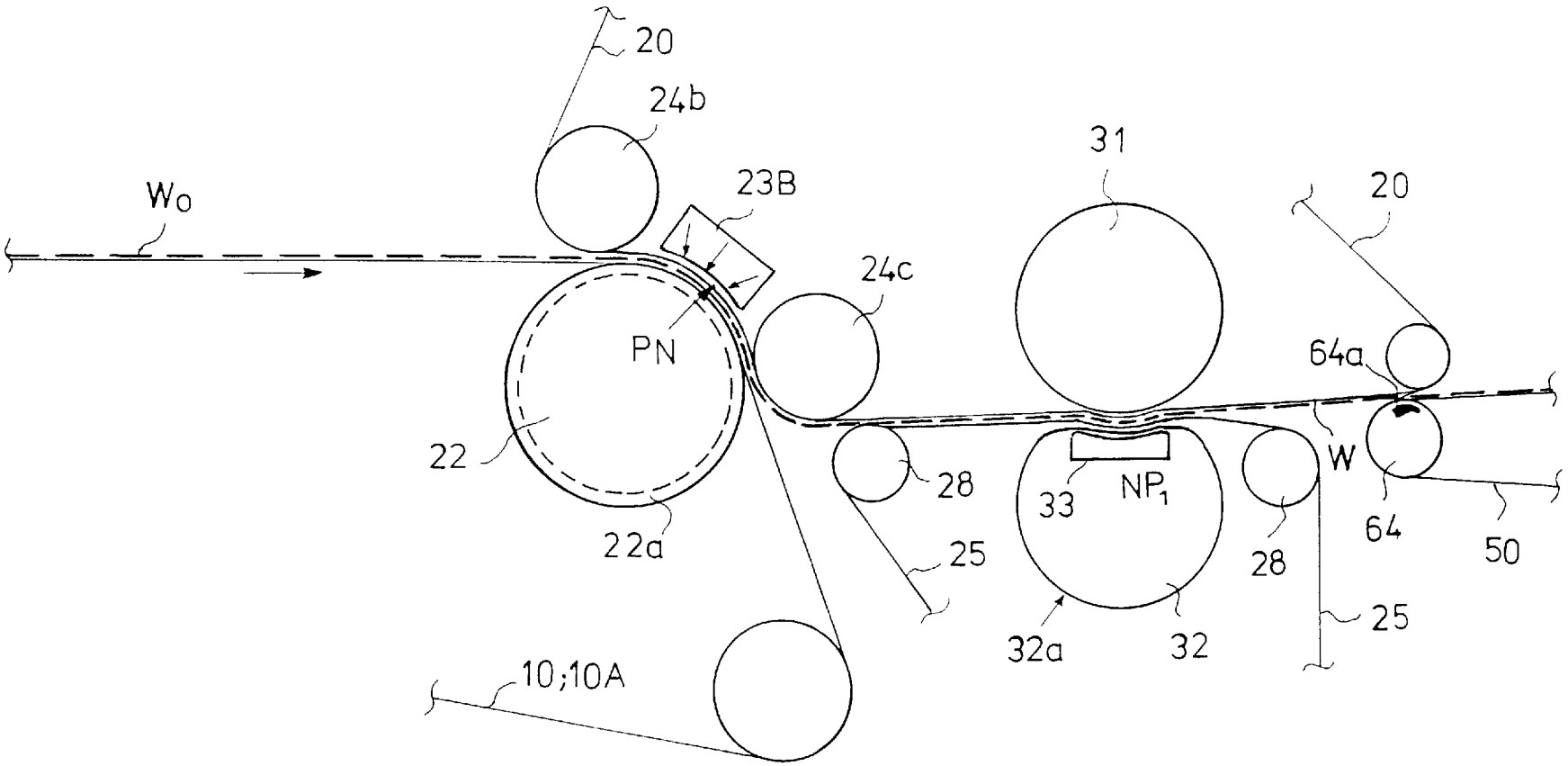
FIG. 12 shows a modification of the press section in accordance with the invention in which an extended-nip zone formed by a shoe press is used as a pre-press zone.

In the manner shown in FIG. 12, in connection with the open-faced 22*a* roll 22 placed inside the loop of the forming wire 10,10A, a pre-press zone PN in accordance with the invention is formed by means of a press shoe 23B. The press shoe 23B forms an extended-nip zone in connection with the roll 22, through which zone the transfer belt 20 runs guided by the guide rolls 24*b* and 24*c*. On the transfer belt 20, the paper web W is passed through the extended-nip zone $NP_1$. The construction of the extended-nip zone $NP_1$ is similar, for example, to the extended-nip zone $NP_1$ shown in FIG. 2. After the extended-nip zone $NP_1$, the paper web W is separated from the lower felt 25, and the web W follows the transfer belt 20 onto the suction zone 64*a* of the suction roll 64 of the drying wire 50, on which zone 64*a* the web W is transferred onto the drying wire 50. By means of the pre-press zone as shown in FIG. 12, as well as by means of the pre-press zones described above, it is possible to eliminate destruction of the web structure by increasing the compression pressure in the pre-press zone PN gradually. When a press shoe 23B is employed, it is also possible to avoid generation of heat in soft pre-press rolls.

In the present invention, an essential component is a transfer belt 20,20A,20B, which substantially does not receive water and which is arranged in the manner described above. It is characteristic of this transfer belt 20,20A,20B that it is substantially impenetrable, i.e., either does not receive water at all or receives water to a slight extent only (but is not completely porous). A further important feature is the capability of adhesion of the transfer belt 20,20A,20B, so that it is capable of directly separating the web after a pre-press zone or equivalent without risk of rewetting. This adhesion capacity is partly based on the smooth or substantially smooth outer face of the transfer belt and on the choice of its materials. The transfer belt 20,20A,20B is substantially non-stretchable. As the material of the transfer belt 20,20A, 20B, it is possible to use various synthetic materials, and it can be provided with metal, composite and/or fabric reinforcements. The thickness of the transfer belt 20,20A,20B is usually dimensioned in the range of from about 1 mm to about 5 mm, so that it endures bending, the compression pressures in the various nips, doctoring, and cleaning with high-pressure water jets.

It is an essential feature of the operation of the transfer belt 20,20A,20B arranged in accordance with the invention that, as the transfer belt 20,20A runs through a pre-press and transfer nip, besides a considerable drainage of water, it is also achieved that, owing to the compression pressure, at the same time the web adheres reliably to the outer face of the transfer belt 20,20B. This contributes to a reliable and direct transfer of the web onto the next press fabric or into the next press nip after the pre-press zone without rewetting and as a closed draw without risk of breaks.

If necessary, the press section in accordance with the invention can be provided with mechanisms for regulating the profiles of the press nip pressures in the machine direction and in the cross direction in compliance with the principles that are described in the current assignee's Finnish Patent Application No. 905798 (corresponding European Publication No. 0 487 483 A1 and U.S. Pat. No. 5,389,205) mentioned above. The regulations of these profiles can be carried out in a way in itself known, for example by regulation of the compression pressure profiles of the press shoes 33,43 in the extended-nip hose rolls 32,42 and/or by regulation of the deflection of the backup rolls 31,41 in the extended nips $NP_1$,$NP_2$. By means of these regulations of profiles, it is possible to control the profiles of the paper produced both in the machine direction and in the cross direction, which profiles are important in view of the quality properties of the paper.

Figure 13:
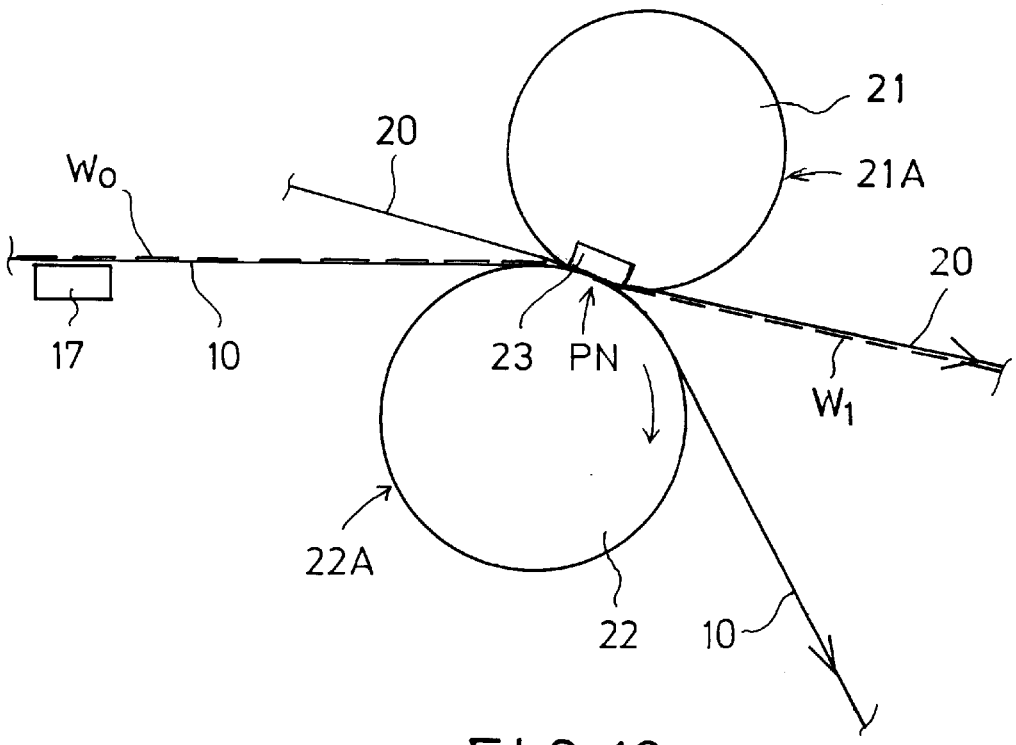
FIG. 13 shows an alternative construction of a pre-press zone in the paper machines in accordance with the invention.

FIG. 13 shows an alternative embodiment of the pre-press zone PN which may be used in the paper machine constructions described herein and arranged either in connection with a forming wire passing through the forming section of the paper machine, in which case the pre-press zone would be arranged in the forming section, or a transfer wire carrying the web after the forming wire, in which case the pre-press zone would be arranged between the forming section and the press section. The pre-press zone PN comprises an extended nip defined by an extended-nip roll 21 in the upper position and a lower roll 22 having a smooth face 22A situated in the loop of the forming or fourdrinier wire 10 to constitute a backing roll for the extended-nip roll 21. Extended-nip roll 21 may be any extended-nip roll known to those in the art such as one that comprises a hose mantle 21A and a press shoe 23 arranged in the interior of a loop defined by the hose mantle 21A. Thus, the embodiment in FIG. 13 differs from the embodiment in FIG. 2 in that a smooth-faced lower roll 22 is provided in nip-defining relationship to the extended-nip roll 21 instead of the hollow-faced lower roll 22*a*. In this regard, it is advantageous to provide the smooth-faced roll 22 in an extended-nip as opposed to the hollow-faced roll because a smooth-faced roll is less expensive and easier to clean than a hollow-faced roll, and also less expensive and easier to clean that a perforated suction roll which may be used as a substitute for the hollow-faced lower roll in the embodiment of FIG. 2 (as noted above). The wear resistance of the wire 10 is also better when a smooth-faced roll is used instead of a hollow-faced roll.

The smooth-faced lower roll 22 induces by its motion a partial vacuum after the nip in the pre-press zone PN which contributes to reducing rewetting of the web $W_1$ since water is drawn into and remains in the wire 10 after the nip.

The magnitude of the open volume of the wire 10 required for dewatering in the pre-press zone PN depends on the water amount contained in the web $W_0$ and the wire 10. In particular, in the case of paper and thin board grades, the water amount of the web $W_0$ after suction flatboxes 17 is so low that the water amount to be pressed can be adequately accommodated in the mesh structure of the wire. For example, when the grammage of the web is 50 g/m$^2$ and the dry solids content of the web is about 10%, the water amount is about 450 g/m$^2$. Similarly, when the grammage of the web is 100 g/m$^2$ and the dry solids content of the web is about 18%, the water amount is about 455 g/m$^2$. The water volume of the wire 10 may be as much as about 1000 g/m$^2$. Thus, it may also contain a certain amount of water when it enters the nip in the pre-press zone PN without causing any problems. Nevertheless, the open volume of the wire 10 must be larger than the total amount of water in the web $W_0$ and in the wire.

The wire 10 is directed from the extended nip in a direction substantially tangent to a point along an outer surface of the smooth-faced lower roll 22.

Instead of the extended-nip roll 21 including a press shoe 23, it is possible to use a fairly, soft press roll as described above.

Figure 14:
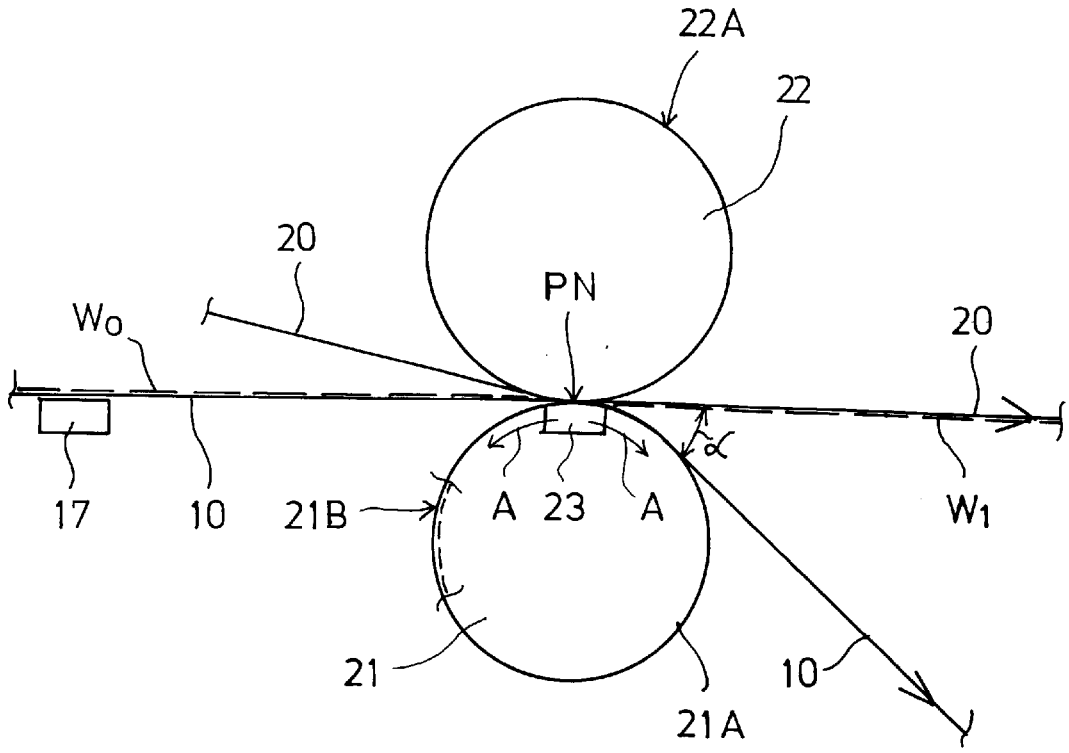
FIG. 14 shows another alternative construction of a pre-press zone in the paper machines in accordance with the invention.

FIG. 14 shows another alternative embodiment of the pre-press zone PN which may be used in the paper machine constructions described herein and arranged either in connection with a forming wire passing through the forming section of the paper machine or a transfer wire carrying the web after the forming wire. In this embodiment, differing from the embodiments of FIGS. 2 and 13, the pre-press zone PN includes a nip defined by an extended-nip roll 21 in a lower position and a smooth-faced back-up roll 22 in the upper position. Thus, the extended-nip roll 21 is situated in the loop of the forming wire 10. Extended-nip roll 21 comprises a hose mantle 21A and a press shoe 23 arranged in the interior of a loop defined by the hose mantle 21A.

Rewetting of the web is of considerable significance to the dry solids content of the web and its importance increases with decreasing grammage of the web that is being manufactured. To this end, it has been found that the outlet angle $\alpha$ between the running direction of the forming wire 10 and the running direction of the transfer belt 20 (and the web $W_1$ carried thereon) is a significant parameter which influences the rewetting of the web, and may be adjusted in order to optimize the rewetting condition of the web, i.e., minimize rewetting of the web, as well as to enhance adherence of the web to the transfer belt 20 and prevent the possible continued running of the web on the forming wire 10. In one embodiment, in order that the outlet angle $\alpha$ between the forming wire 10 and the transfer belt 20 may be optimal with respect to both rewetting of the web, i.e., preventing rewetting of the web, and mechanical construction, it is possible to adjust the position of the extended-nip roll 21 relative to the back-up roll 22. Also, it is contemplated that the location of the press shoe 23 is also adjustable by suitable adjusting means (represented by the arrows A). The optimum outlet angle $\alpha$ and the location of the extended-nip roll 21, in the upper position shown in FIG. 13 or in similar circumstances in the lower position shown in FIG. 14, may be different when the grammages of the paper being manufactured and the running speeds of the web through the paper machine are different.

The wire 10 is directed from the extended nip in a direction substantially tangent to a point along an outer surface of the extended-nip roll 21.

The hose mantle 21A of the extended-nip roll 21 may be grooved (as represented by section 21B), blind-drilled or smooth. In the latter case, the open volume of the wire 10 must be larger than the total amount of water in the web $W_0$ and the wire 10 before the press nip.

Figure 15A:
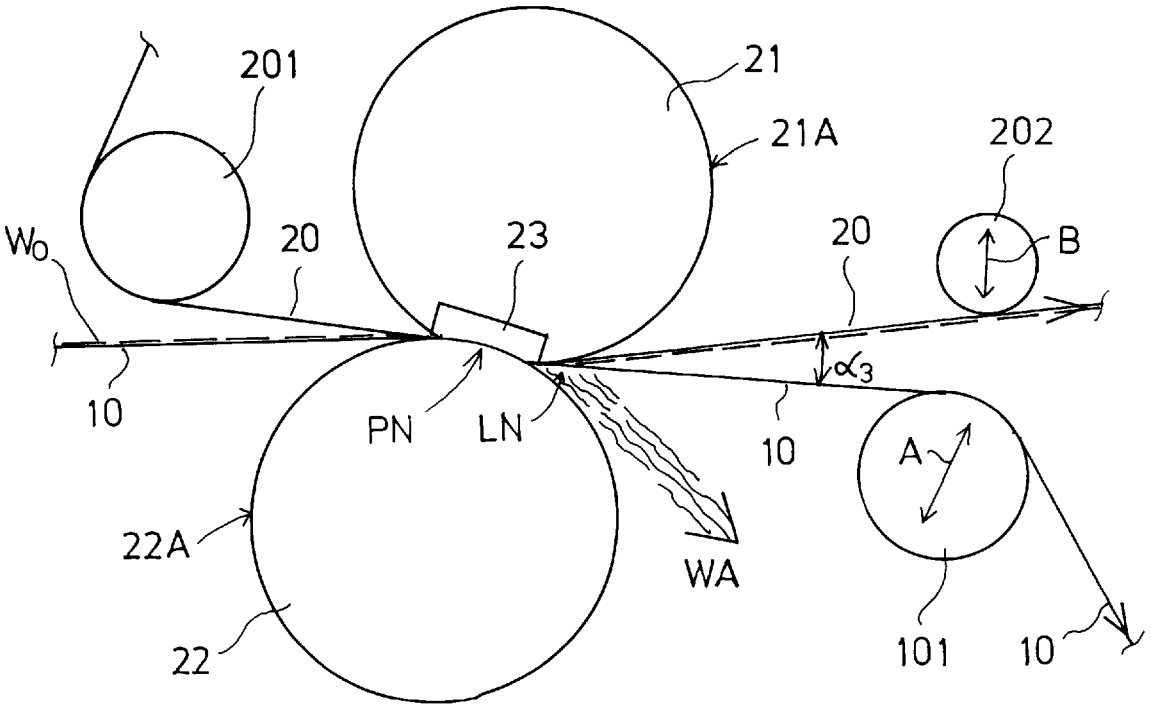
FIG. 15A shows still another alternative construction of a pre-press zone in the paper machines in accordance with the invention.
Figure 15B:
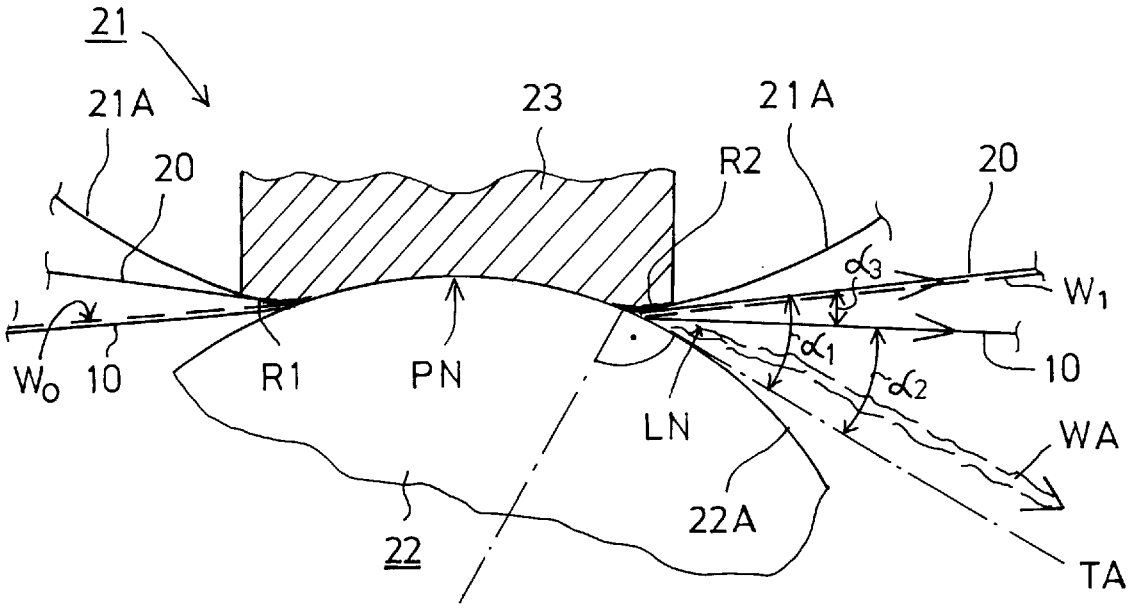
FIG. 15B is an enlarged view of the pre-press zone of the embodiment shown in FIG. 15A.

FIGS. 15A and 15B show another alternative embodiment of the pre-press zone PN which may be used in the paper machine constructions described herein and arranged either in connection with a forming wire passing through the forming section of the paper machine or a transfer wire carrying the web after the forming wire. The pre-press zone PN comprises an extended nip defined by an extended-nip roll 21 in the upper position and a lower roll 22 having a smooth face 22A situated in the loop of the forming or fourdrinier wire 10 (or the pre-press and transfer wire 10W if incorporated into the embodiment shown in FIG. 4) to constitute a backing or back-up roll for the extended-nip roll 21. Extended-nip roll 21 comprises a hose mantle 21A and a press shoe 23 arranged in the interior of a loop defined by the hose mantle 21A.

As shown in FIG. 15B, the press shoe 23 of the extended-nip roll 21, which in this case may be a hose roll, has a curved front edge R1 which guides the hose mantle 21A and the transfer belt 20 into the extended nip. The wire 10 and the web $W_0$ supported thereon arrive at the extended nip substantially tangentially to the inlet of the extended nip. The press shoe 23 also includes a curved trailing edge R2 around which the hose mantle 21A and the transfer belt 20, as well as the web $W_1$ which is now supported on the transfer belt 20, run at an angle $\alpha 2$ with respect to a plane TA tangent to an outer surface of the lower roll 22 at a beginning of the trailing edge of the press shoe 23, which is not in the direction tangent to an outer surface of the lower roll. After the trailing edge R2, the wire 10 continues to run at the angle $\alpha 2$ with respect to the tangent plane while the transfer belt 20 and web being supported therein are guided to run an angle $\alpha 1$ with respect to the tangent plane which is larger than the angle $\alpha 2$ so that the web is distanced from the water-laden wire 10 thereby preventing rewetting of the web from water in the wire 10. Accordingly, the wire 10 and transfer belt 20 separate from one another after the trailing edge R2 of the press shoe 23 at an angle $\alpha 3$ (which equals $\alpha 1-\alpha 2$).

Water is removed obliquely downward aided by a vacuum induced in the opening nip LN and by gravity forces after the trailing edge of the press shoe 23 primarily in the direction of arrow WA which is close to the direction of the tangent plane TA.

Rewetting of the web $W_1$ after the pre-press zone PN is a problem and is affected by, among other things, the running direction of the transfer belt 20 and the wire 10, e.g., the angles at which the transfer belt 20 and wire 10 run in relation to the tangent plane TA, viz., $\alpha 1$, $\alpha 2$ and $\alpha 3$. It has been found that rewetting of the web is optimally avoided when both the transfer belt 20 and the wire 10 curve at the same angle over the trailing edge R2 of the press shoe 23 of the extended-nip roll 21 (which may the same as or different than the angle at which the wire 10 runs after the trailing edge). This angle may be selected or determined to optimize the prevention of rewetting of the web. One advantage of this embodiment is that water is removed (arrow WA), owing to the centrifugal force and the suction effect produced by the backing roll 21, in the direction away from the web $W_1$ through the wire 10 thereby reducing rewetting of the web $W_1$. Also, the direction WA of the removed water is downward, which improves the press section concept. At increasing machine running speeds, the dry solids content of the web $W_1$ increases, which is natural since the centrifugal force also increases.

However, after the trailing edge of the press shoe, the angle of the running direction of the transfer belt 20 relative to the tangent plane is greater than the angle of the running direction of the wire 10 relative to the tangent plane in order to effectively prevent rewetting of the web. Indeed, the angles of the running direction of the transfer belt 20 and wire 10 after the trailing edge R2 of the press shoe 23 may be selected with the overall objective of affecting rewetting of the web after the extended nip, i.e., minimizing rewetting of the web. To this end, a guide roll 202 may be arranged in a loop of the transfer belt 20 after the extended-nip roll 21 and the position of the guide roll 202 adjusted by appropriate adjusting means (represented by arrow B) to vary the angles $\alpha 1$ and $\alpha 3$, i.e., the angle at which the transfer belt 20 and web run after the extended nip causing a change in the angle at which the web separates from the wire 10, and thereby affect rewetting of the web after the extended nip. In addition to or instead of the adjustment of the running direction of transfer belt 20 after the extended nip, it is possible to arrange a guide roll 101 in a loop of the wire 10 after the backing roll 21 and adjust the position of the guide roll 101 (by adjusting means represented by arrow A) to vary the angles $\alpha 2$ and $\alpha 3$, i.e., the angle at which the wire 10 runs after the extended nip causing a change in the angle at which the web separates from the wire 10, and thereby affect rewetting of the web after the extended nip and increase the adherence of the web to the transfer belt after the extended nip.

The web $W_1$ follows the transfer belt 20 reliably after the pre-press zone PN because of the angles of departure of the transfer belt 20 and wire 10 from the extended nip in the pre-press zone PN.

The examples provided above are not meant to be exclusive. Many other variations of the present invention would be obvious to those skilled in the art, and are contemplated to be within the scope of the appended claims.

We claim:

1. A method for dewatering a paper or board web while passing the web from a forming section to a press section, the web being carried on a forming wire in the forming section, comprising the steps of:

guiding the forming wire carrying the web thereon into a pre-press zone, forming an extended nip in the pre-press zone between an extended-nip roll and a smooth-faced press roll, the extended-nip roll having a hose mantle and a press shoe arranged in a loop of the hose mantle, one of the extended-nip roll and the smooth-faced press roll being arranged in a loop of the forming wire, guiding a substantially non-water-receiving transfer belt into the pre-press zone to engage the web in the extended nip, the other of the extended-nip roll and the smooth-faced press roll being arranged in a loop of the transfer belt, transferring the web in the extended nip in the pre-press zone from the forming wire to the transfer belt such that at a location substantially immediately after the pre-press zone, the web is supported on only the transfer belt and the forming wire has separated from the web, and thereafter passing the web on support of the transfer belt into engagement with a press fabric or additional wire in the press section and/or into a press nip of the press section.

2. The method of claim 1, further comprising the step of:

directing the forming wire from the extended nip in a direction tangent to an outer surface of one of the extended-nip roll or smooth-faced press roll over which the forming wire runs.

3. The method of claim 1, further comprising the steps of:

arranging the smooth-faced press roll in the loop of the forming wire, and arranging the extended-nip roll in the loop of the transfer belt and above the smooth-faced press roll such that the extended-nip roll is in an upper position in the extended nip and the smooth-faced roll is in a lower position in the extended nip.

4. The method of claim 1, further comprising the steps of:

guiding the transfer belt after the pre-press zone in a direction at a first angle relative to a plane tangent to an outer surface of the extended-nip roll or smooth-faced press roll over which the forming wire runs at a beginning of a trailing edge of the press shoe, guiding the forming wire after the pre-press zone in a direction at a second angle relative to the tangent plane, smaller than the first angle and not in a direction tangent to an outer surface of the smooth-faced press roll, a third angle being defined as the difference between the first and second angles and representing the difference in the running direction of the transfer belt and forming wire, and selecting the first and second angles to determine the third angle and thereby affect rewetting of the web after the extended nip.

5. The method of claim 4, wherein the step of guiding the transfer belt after the pre-press zone at the first angle comprises the step of arranging a guide roll in a loop of the transfer belt after the extended nip, further comprising the step of:

adjusting the position of the guide roll to vary the first and third angles and affect rewetting of the web after the extended nip.

6. The method of claim 4, wherein the step of guiding the forming wire after the pre-press zone at the second angle comprises the step of arranging a guide roll in a loop of the forming wire after the extended nip, further comprising the step of:

adjusting the position of the guide roll to vary the second and third angles and affect rewetting of the web after the extended nip and increase the adherence of the web to the transfer belt after the extended nip.

7. The method of claim 3, further comprising the step of:

guiding the forming wire over a trailing edge of the press shoe at a first angle relative to a plane tangent to an outer surface of the smooth-faced press roll at a beginning of the trailing edge of the press shoe and not in a direction tangent to an outer surface of the smooth-faced press roll, guiding the transfer belt at the first angle over the trailing edge of the press shoe, continuing to guide the forming wire at the first angle after the trailing edge of the press shoe, guiding the transfer belt to run at a second angle to the run of the forming wire after the trailing edge of the press shoe to cause the web to separate from the forming wire, and selecting the second angle to affect rewetting of the web after the extended nip.

8. The method of claim 1, further comprising the steps of:

arranging the extended-nip roll in the loop of the forming wire, and arranging the smooth-faced press roll in the loop of the transfer belt and above the extended-nip roll such that the extended-nip roll is in a lower position in the extended nip and the smooth-faced roll is in an upper position in the extended nip.

9. The method of claim 1, further comprising the step of:

adjusting the position of the press shoe in the extended-nip roll in order to affect rewetting of the web after the extended nip.

10. A method for dewatering a paper or board web while passing the web from a forming section to a press section, the web being carried on a forming wire in the forming section, comprising the steps of:

guiding the forming wire carrying the web thereon into a pre-press zone, forming an extended nip in the pre-press zone between an extended-nip roll and a press roll, the extended-nip roll having a hose mantle and a press shoe arranged in a loop of the hose mantle, one of the extended-nip roll and the press roll being arranged in a loop of the forming wire, guiding a substantially non-water-receiving transfer belt into the pre-press zone to engage the web in the extended nip, one of the extended-nip roll and the press roll being arranged in a loop of the forming wire, transferring the web in the extended nip in the pre-press zone from the forming wire to the transfer belt such that at a location substantially immediately after the pre-press zone, the web is supported on only the transfer belt and the forming wire has separated from the web, and thereafter passing the web on support of the transfer belt into engagement with a press fabric or additional wire in the press section and/or into a press nip of the press section.

11. The method of claim 10, further comprising the steps of:

arranging the extended-nip roll in a loop of the forming wire, and arranging the press roll in a loop of the transfer belt and above the extended-nip roll such that the extended-nip roll is in a lower position in the extended nip and the smooth-faced roll is in an upper position in the extended nip.

12. In a paper or board machine including a forming section for forming a web, a press section including at least one press zone for dewatering the web, and a dryer section for drying the web, comprising a pre-press zone for pressing the web arranged at the end of the forming section, said pre-press zone including an extended nip comprising an extended-nip roll and a smooth-faced press roll, said extended-nip roll having a hose mantle and a press shoe arranged in a loop of said hose mantle, a forming wire running through the forming section and for carrying the web into said extended nip, one of said smooth-faced press roll and said extended-nip roll being arranged in a loop of said forming wire, a substantially non-water-receiving transfer belt having an outer face to which the web is adherable, the other of said smooth-faced press roll and said extended-nip roll being arranged in a loop of said transfer belt, and first guide means for guiding said transfer belt through said extended nip, the web being transferred from said forming wire to said transfer belt in said extended nip such that it adheres to the outer face of said transfer belt and is separated from said forming wire substantially immediately after said pre-press zone, the web being carried by said transfer belt from said pre-press zone into the at least one press zone in the press section or to be transferred onto a press fabric of the press section.

13. The paper or board machine of claim 12, wherein said smooth-faced press roll is arranged in the loop of said forming wire and said extended-nip roll is arranged in the loop of said transfer belt and above said smooth-faced press roll such that said extended-nip roll is in an upper position in said extended nip and said smooth-faced roll is in a lower position in said extended nip.

14. The paper or board machine of claim 12, wherein said smooth-faced press roll is arranged in the loop of said transfer belt and said extended-nip roll is arranged in the loop of said forming wire below said smooth-faced press roll such that said extended-nip roll is in a lower position in said extended nip and said smooth-faced press roll is in an upper position in said extended nip.

15. The paper or board machine of claim 12, further comprising second guide means for guiding said forming wire after said extended nip in a direction tangent to an outer surface of a lowermost one of said extended-nip roll and said smooth-faced press roll.

16. The paper or board machine of claim 12, wherein said first guide means are structured and arranged to guide said transfer belt after said pre-press zone in a direction at a first angle relative to a plane tangent to an outer surface of a lowermost one of said extended-nip roll and said smooth-faced press roll at a beginning of a trailing edge of said press shoe, further comprising second guide means for guiding said forming wire after said pre-press zone in a direction at a second angle relative to the tangent plane, smaller than said first angle and not in a direction tangent to an outer surface of said lowermost one of said extended-nip roll and said smooth-faced press roll.

17. The paper or board machine of claim 16, wherein said first guide means comprise a guide roll arranged in a loop of said transfer belt after said extended nip, and means for adjusting the position of said guide roll to vary said first angle and affect rewetting of the web after said extended nip.

18. The paper or board machine of claim 16, wherein said second guide means comprise a guide roll arranged in a loop of said forming wire after said extended nip, and means for adjusting the position of said guide roll to vary said second angle and affect rewetting of the web after the extended nip and increase adherence of the web to said transfer belt after said extended nip.

19. The paper or board machine of claim 12, further comprising means for adjusting the position of said press shoe in said extended-nip roll in order to affect rewetting of the web after said extended nip.

20. In a paper or board machine including a forming section for forming a web, a press section including at least one press zone for dewatering the web, and a dryer section for drying the web, comprising a pre-press zone for pressing the web arranged at the end of the forming section, said pre-press zone including an extended nip comprising an extended-nip roll and a press roll, said extended-nip roll having a hose mantle and a press shoe arranged in a loop of said hose mantle, a forming wire running through the forming section and for carrying the web into said extended nip, one of said press roll and said extended-nip roll being arranged in a loop of said forming wire, a substantially non-water-receiving transfer belt having an outer face to which the web is adherable, the other of said press roll and said extended-nip roll being arranged in a loop of said forming wire, and first guide means for guiding said transfer belt through said extended nip, the web being transferred from said forming wire to said transfer belt in said extended nip such that it adheres to the outer face of said transfer belt and is separated from said forming wire substantially immediately after said pre-press zone, the web being carried by said transfer belt from said pre-press zone into the at least one press zone in the press section or to be transferred onto a press fabric of the press section.

21. The paper or board machine of claim 20, wherein said press roll is arranged in a loop of said transfer belt and said extended-nip roll is arranged in a loop of said forming wire below said press roll such that said extended-nip roll is in a lower position in said extended nip and said press roll is in an upper position in said extended nip.

22. In a press section in a paper or board machine, the machine including a forming section having a forming wire on which a web is supported, a press section including at least one press zone, and a dryer section having a drying wire on which the web is supported, the web being transferred into a first one of said press zones from the forming wire, the press section comprising a first pre-press zone for pressing the web through which the forming wire with the web supported thereon is directed, a substantially non-water-receiving transfer belt having an outer face to which the web is adherable, first guide means for guiding said transfer belt in a loop through said first pre-press zone such that the web is dewatered primarily in a direction of the forming wire and through the forming wire in said first pre-press zone, said first pre-press zone including a first press nip defined by a first roll arranged in a loop of the forming wire and a second roll arranged in the loop of said transfer belt, the web being transferred from the forming wire to said transfer belt in said first pre-press zone such that it adheres to the outer face of said transfer belt in said first pre-press zone and being separated from the forming wire in or substantially immediately after said first pre-press zone, a first water-receiving press fabric guided in a loop, the web being transferred after said first pre-press zone from said transfer belt to said first water-receiving press fabric and said transfer belt being separated from the web such that the web is supported only on said first water-receiving press fabric, and means arranged after a location at which the web is transferred to said first water-receiving press fabric for transferring the web to the drying wire.

23. In a press section in a paper or board machine, the machine including a forming section having a forming wire on which a web is supported, a press section including at least one press zone, and a dryer section, the web being transferred into a first one of said press zones from the forming wire, the press section comprising a first pre-press zone for pressing the web through which the forming wire with the web supported thereon is directed, said first pre-press zone comprising a web adhering nip having a relatively low loading between about 15 kN/m and about 40 kN/m, a substantially non-water-receiving transfer belt having an outer face to which the web is adherable, first guide means for guiding said transfer belt in a loop through said first pre-press zone such that the web is dewatered in a direction of the forming wire and through the forming wire in said first pre-press zone, said web adhering nip being defined by a first roll arranged in a loop of the forming wire and a second roll arranged in a loop of said transfer belt, the web being transferred from the forming wire to said transfer belt in said first pre-press zone such that it adheres to the outer face of said transfer belt in said first pre-press zone and being separated from the forming wire in or substantially immediately after said first pre-press zone, a second pre-press zone arranged after said first pre-press zone in the running direction of the web, said transfer belt being guided by said first guide means through said second pre-press zone, a pre-press wire, and second guide means for guiding said pre-press wire into engagement with the web after said first pre-press zone and before said second pre-press zone and through said second pre-press zone, said pre-press wire having a relatively open and permeable fabric structure, the web being carried by said transfer belt from said second pre-press zone to be transferred onto a press fabric.

* * * * *